US011992104B2

(12) United States Patent
Sullivan et al.

(10) Patent No.: US 11,992,104 B2
(45) Date of Patent: May 28, 2024

(54) CONTAINER WITH RESEALABLE CLOSURE

(71) Applicant: YETI Coolers, LLC, Austin, TX (US)

(72) Inventors: Derek G. Sullivan, Austin, TX (US); John Warren Dow, Austin, TX (US); Calvin Tabor, Austin, TX (US); Kyle Edward Rogers, Austin, TX (US); Erik Steven Larson, Austin, TX (US); Keith Austin, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 17/673,688

(22) Filed: Feb. 16, 2022

(65) Prior Publication Data

US 2023/0255334 A1 Aug. 17, 2023

(51) Int. Cl.

| | |
|---|---|
| ***A45C 13/10*** | (2006.01) |
| ***A45C 3/00*** | (2006.01) |
| ***A45F 3/04*** | (2006.01) |

(52) U.S. Cl.

CPC ..... *A45C 13/1069* (2013.01); *A45C 3/001* (2013.01); *A45F 3/04* (2013.01)

(58) Field of Classification Search

CPC .... A45C 13/1069; B65D 33/16; B65D 33/24; B65D 33/30

USPC ..... 383/33, 34, 34.1, 48

See application file for complete search history.

(56) References Cited

U.S. PATENT DOCUMENTS

| | | | | | |
|---|---|---|---|---|---|
| 1,513,395 | A | * | 10/1924 | Holmes | A47L 9/149 383/69 |
| 1,631,371 | A | | 6/1927 | Greubel | |
| 1,671,385 | A | | 5/1928 | Strayer | |
| 1,712,109 | A | * | 5/1929 | Hammer | A45C 11/22 206/811 |
| 1,809,696 | A | | 6/1931 | Heilweil | |
| 1,899,696 | A | | 2/1933 | Freedman et al. | |
| 1,942,246 | A | | 1/1934 | Johaneson | |
| 1,982,845 | A | * | 12/1934 | Wagman | A45C 3/06 383/33 |
| 1,986,057 | A | | 1/1935 | Hackworth | |
| 2,304,528 | A | | 12/1942 | Bafia | |
| 2,496,296 | A | | 2/1950 | Lobl | |
| 2,513,575 | A | | 7/1950 | Lombard | |
| 2,522,480 | A | | 9/1950 | Lionel | |

(Continued)

FOREIGN PATENT DOCUMENTS

| | | | |
|---|---|---|---|
| CA | 179459 | A | 9/1917 |
| CA | 185600 | A | 7/1918 |

(Continued)

OTHER PUBLICATIONS

Sep. 30, 2022—(JP) Office Action—App. No. 2021-552882.

(Continued)

*Primary Examiner* — Scott T McNurlen

(74) *Attorney, Agent, or Firm* — Banner & Witcoff, Ltd.

(57) ABSTRACT

A container device with an outer shell that has an opening that is sealed by a closure mechanism. The closure mechanism may include resealable closure elements that are configured to partially or wholly seal the opening. In some examples, the closure elements may be magnetic strips. In addition, the closure mechanism may include curved members to prevent the opening from closing when the closure mechanism is in an open configuration.

25 Claims, 19 Drawing Sheets

(56) References Cited

U.S. PATENT DOCUMENTS 2,627,097 A 2/1953 Ellis
2,672,232 A 3/1954 Kessell, Jr.
2,784,757 A 3/1957 Requa
3,102,314 A 9/1963 Alderfer
3,111,735 A 11/1963 Ellis
3,161,932 A 12/1964 Russell
3,455,359 A 7/1969 Schweizer
3,716,091 A 2/1973 Gaines
3,749,301 A 7/1973 Peckar
3,827,019 A 7/1974 Serbu
3,831,986 A 8/1974 Kobayashi
3,998,304 A 12/1976 Edgerton, Jr. et al.
4,033,013 A 7/1977 Peterson
D256,097 S 7/1980 Amberg
4,213,549 A 7/1980 Hibbard
4,258,493 A 3/1981 Kettlestrings et al.
4,399,595 A 8/1983 Yoon et al.
4,408,643 A 10/1983 Laske et al.
4,421,150 A 12/1983 Masters
4,489,770 A 12/1984 Reich, II
D284,254 S 6/1986 Carlson
4,679,242 A 7/1987 Brockhaus
4,716,947 A 1/1988 Haddock
4,738,390 A 4/1988 Brennan
4,810,102 A 3/1989 Norton
D304,008 S 10/1989 Hornung
4,898,477 A 2/1990 Cox et al.
4,905,857 A 3/1990 Her
4,911,962 A 3/1990 Baumann et al.
4,988,216 A 1/1991 Lyman
5,010,988 A 4/1991 Brown
5,030,013 A 7/1991 Kramer
5,148,580 A 9/1992 Dyckow
5,174,658 A 12/1992 Cook et al.
5,181,555 A 1/1993 Chruniak
5,184,896 A 2/1993 Hammond et al.
5,196,818 A 3/1993 Anderson
5,216,900 A 6/1993 Jones
5,226,540 A 7/1993 Bradbury
5,237,838 A 8/1993 Merritt-Munson
5,244,136 A 9/1993 Collaso
D343,288 S 1/1994 Chao
D350,689 S 9/1994 Chao
5,370,622 A 12/1994 Livingston et al.
5,371,925 A 12/1994 Sawatsky
5,372,429 A 12/1994 Beaver, Jr. et al.
5,473,799 A 12/1995 Aoki
5,505,305 A 4/1996 Scholz et al.
D372,173 S 7/1996 Fukuda et al.
5,540,366 A 7/1996 Coomber
5,604,960 A 2/1997 Good
D381,506 S 7/1997 Roeder
5,645,205 A 7/1997 Kennedy
D383,360 S 9/1997 Melk
D386,611 S 11/1997 Sheu
5,682,653 A 11/1997 Berglof et al.
5,704,480 A 1/1998 Scholz et al.
5,706,940 A 1/1998 Amarello
5,746,638 A 5/1998 Shiraishi
5,797,683 A 8/1998 Gunzi et al.
5,816,709 A 10/1998 Demus
5,844,772 A 12/1998 Lee et al.
D406,730 S 3/1999 Freese et al.
5,875,795 A 3/1999 Bouix
D411,416 S 6/1999 Freese et al.
D411,446 S 6/1999 Cautereels
5,908,245 A 6/1999 Bost et al.
D412,267 S 7/1999 Anderson
D421,371 S 3/2000 Fair
6,067,813 A 5/2000 Smith
6,068,119 A 5/2000 Derr et al.
6,070,628 A 6/2000 Nastasi
6,073,789 A 6/2000 Lundblade
6,092,707 A 7/2000 Bowes, Jr.
6,112,959 A 9/2000 Townsend
6,139,185 A 10/2000 Hamilton et al.
6,149,305 A 11/2000 Fier
6,179,677 B1 1/2001 Dornier
6,223,551 B1 5/2001 Mitchell
6,224,258 B1 5/2001 Dodson
6,226,842 B1 5/2001 Wong
6,301,754 B1 10/2001 Grunberger et al.
6,336,340 B1 1/2002 Laby
6,361,210 B2 3/2002 Denko
6,397,560 B1 6/2002 Weder
D460,898 S 7/2002 Wang
6,412,116 B1 7/2002 Clark
6,422,032 B1 7/2002 Greene
6,427,475 B1 8/2002 DeFelice et al.
6,434,801 B2 8/2002 Grunberger
D463,276 S 9/2002 Piscopo et al.
6,468,624 B1 10/2002 Fujisawa et al.
6,470,705 B2 10/2002 Bride-Flynn
6,505,385 B2 1/2003 Grunberger
D472,773 S 4/2003 Samartgis
D478,782 S 8/2003 Li
6,601,403 B1 8/2003 Roth et al.
D482,529 S 11/2003 Hardigg et al.
6,646,864 B2 11/2003 Richardson
6,659,274 B2 12/2003 Enners
D485,069 S 1/2004 Parker
6,678,923 B2 1/2004 Goldberg et al.
6,698,608 B2 3/2004 Parker et al.
6,722,784 B2 4/2004 Breil, Jr.
6,742,354 B1 6/2004 Watts
6,749,551 B2 6/2004 Metzler et al.
6,779,199 B1 8/2004 O'Dea et al.
6,821,018 B1 11/2004 Denko
6,899,460 B2 * 5/2005 Turvey ..... B65D 33/2508 383/33
6,904,647 B2 6/2005 Byers, Jr.
6,915,934 B2 7/2005 Hassett
6,929,125 B1 8/2005 Seamans
6,955,381 B2 10/2005 Parker et al.
D513,123 S 12/2005 Richardson et al.
D513,451 S 1/2006 Richardson et al.
D514,808 S 2/2006 Morine et al.
D516,309 S 3/2006 Richardson et al.
D516,807 S 3/2006 Richardson et al.
D516,870 S 3/2006 Martinez et al.
7,017,776 B1 3/2006 Hupp
7,033,657 B2 4/2006 Martin
D523,242 S 6/2006 Hardigg et al.
D527,226 S 8/2006 Maldonado
D529,344 S 10/2006 Maldonado
7,187,261 B2 3/2007 Cassar
D543,700 S 6/2007 Parker et al.
D550,210 S 9/2007 Polany et al.
7,299,652 B2 11/2007 Gagnon
7,301,303 B1 11/2007 Hulden
7,364,361 B2 4/2008 Turvey et al.
D573,844 S 7/2008 Hanson et al.
7,400,917 B2 7/2008 Wood et al.
D577,261 S 9/2008 Wang
D578,409 S 10/2008 Clark
7,496,195 B2 2/2009 Kramer
7,513,633 B2 4/2009 Ermeti
D592,910 S 5/2009 Hanson et al.
7,527,430 B2 5/2009 Suskind
D598,647 S 8/2009 Kertesz et al.
D601,383 S 10/2009 Shah
D602,740 S 10/2009 Urquiola
D607,701 S 1/2010 Pedrazzi et al.
D609,005 S 2/2010 Dolce et al.
D609,056 S 2/2010 Pierce
D609,470 S 2/2010 Guyon et al.
7,665,895 B2 2/2010 Takita et al.
D617,149 S 6/2010 Olivari
7,730,739 B2 6/2010 Fuchs
D620,249 S 7/2010 Yu
D620,376 S 7/2010 Peyser et al.
D620,707 S 8/2010 Mogil
D623,406 S 9/2010 Yu
D623,853 S 9/2010 Yu

(56) References Cited

U.S. PATENT DOCUMENTS 7,793,782 B2 9/2010 Chuang
D627,199 S 11/2010 Pruchnicki
D630,013 S 1/2011 Yu
D630,939 S 1/2011 Peters et al.
D632,074 S 2/2011 Chan et al.
7,896,199 B2 3/2011 Kaczmarek
7,946,765 B2 5/2011 Melvan et al.
D644,024 S 8/2011 Jobert
8,005,251 B2 8/2011 Chan
D648,935 S 11/2011 Wickrama
D653,915 S 2/2012 George
D664,425 S 7/2012 Krupa
8,209,995 B2 7/2012 Kieling et al.
8,223,997 B2 7/2012 Wilson, II et al.
D668,119 S 10/2012 Everson
D670,906 S 11/2012 Du
8,302,749 B2 11/2012 Melmon et al.
D677,511 S 3/2013 Gray
8,399,764 B2 3/2013 Klosky
8,403,975 B2 3/2013 Hadas
8,424,680 B2 4/2013 Fair et al.
8,434,617 B1 5/2013 Wang
D685,575 S 7/2013 Cullen et al.
D688,449 S 8/2013 Schinasi
8,550,714 B2 10/2013 Ben-Shushan et al.
D693,573 S 11/2013 Holefleisch
8,573,002 B2 11/2013 Ledoux et al.
D694,521 S 12/2013 Robinson et al.
D695,015 S 12/2013 Robinson et al.
D695,568 S 12/2013 Hayes
8,607,536 B2 12/2013 Bailey et al.
D701,456 S 3/2014 Farley et al.
D703,493 S 4/2014 de Ste. Croix et al.
D708,848 S 7/2014 Zwetzig
D709,333 S 7/2014 Stamatopoulos
D709,334 S 7/2014 Stamatopoulos
8,770,402 B2 7/2014 Bergreen et al.
D716,551 S 11/2014 Taylor
D718,529 S 12/2014 Wang
8,939,642 B2 1/2015 Ackerman et al.
D727,107 S 4/2015 Parodi, Jr.
D734,642 S 7/2015 Vasbinder et al.
D734,643 S 7/2015 Boroski
D734,761 S 7/2015 Ballou et al.
D736,569 S 8/2015 Bronwasser et al.
9,122,941 B2 9/2015 Hoobler et al.
9,139,352 B2 9/2015 Seiders et al.
9,167,876 B2 10/2015 Yamaguchi et al.
D745,272 S 12/2015 Slimane
9,220,328 B2 12/2015 Magness
9,264,089 B2 2/2016 Tages
D751,814 S 3/2016 Louboutin
9,290,313 B2 3/2016 De Lesseux et al.
9,307,315 B2 4/2016 McKeough
9,334,087 B2 5/2016 Cho et al.
D758,805 S 6/2016 Myoung
9,392,855 B2 7/2016 Taylor
D763,569 S 8/2016 Tal
D763,629 S 8/2016 Swartz et al.
D764,791 S 8/2016 Patel
9,444,506 B2 9/2016 Lai et al.
D780,524 S 3/2017 Jacobsen
D787,821 S 5/2017 Liu
9,687,054 B2 6/2017 Platt et al.
D798,670 S 10/2017 Seiders et al.
9,901,163 B2 * 2/2018 Pactanac ..... A63B 55/408
D811,738 S 3/2018 Dumas
D811,823 S 3/2018 Kandel
9,913,551 B1 3/2018 Baker
D824,664 S 8/2018 Munie
D824,675 S 8/2018 Munie
D825,184 S 8/2018 Munie
D825,913 S 8/2018 Barlier
D827,299 S 9/2018 Vickery
D828,112 S 9/2018 Furneaux et al.
D835,949 S 12/2018 Triska et al.
10,229,395 B2 3/2019 Smith et al.
D847,499 S 5/2019 Dumas
D850,100 S 6/2019 Oviedo-Polanco
D855,994 S 8/2019 Munie
10,373,128 B2 8/2019 Smith et al.
D861,338 S 10/2019 Seiders et al.
10,494,146 B2 12/2019 Verma
10,548,391 B2 2/2020 Satterfield
D877,514 S 3/2020 Seiders et al.
10,582,734 B1 3/2020 Price
10,586,641 B2 3/2020 Good
10,597,197 B2 3/2020 Verma
10,602,833 B2 3/2020 Powell
D883,047 S 5/2020 Kou
10,660,428 B2 5/2020 Moreau et al.
10,696,085 B2 6/2020 Feingold
10,743,597 B2 8/2020 Tong
10,781,028 B2 * 9/2020 Munie ..... A45C 13/10
10,856,594 B2 12/2020 Smith, IV et al.
D909,063 S 2/2021 Loudenslager et al.
10,981,716 B2 4/2021 Seiders et al.
D919,298 S 5/2021 Munie
11,027,889 B1 6/2021 Western et al.
11,076,666 B2 8/2021 Sullivan et al.
D935,770 S 11/2021 Loudenslager et al.
11,174,077 B2 * 11/2021 Dais ..... B65D 33/25865
11,174,090 B2 11/2021 Rogers
11,229,268 B2 1/2022 Munie et al.
11,266,215 B2 3/2022 Larson et al.
D961,261 S 8/2022 Nichols et al.
2001/0051378 A1 12/2001 Radmacher et al.
2002/0012480 A1 1/2002 Konno
2003/0116461 A1 6/2003 Colloton
2004/0165332 A1 8/2004 Beson
2004/0173484 A1 9/2004 Bates et al.
2004/0183313 A1 9/2004 Sherman et al.
2004/0237266 A1 12/2004 Wang
2004/0238303 A1 12/2004 Hafif
2005/0097711 A1 5/2005 Halstead
2005/0116003 A1 6/2005 Butler et al.
2005/0145302 A1 7/2005 Mutterer et al.
2005/0230465 A1 10/2005 Metzler et al.
2005/0262871 A1 12/2005 Bailey-Weston
2006/0003709 A1 1/2006 Wood
2006/0006969 A1 1/2006 Cassar
2006/0016841 A1 1/2006 Shurm
2006/0072857 A1 4/2006 Revels
2006/0090976 A1 5/2006 Repke et al.
2007/0051785 A1 3/2007 Roessiger
2007/0215663 A1 9/2007 Chongson et al.
2007/0232109 A1 10/2007 Parker et al.
2007/0261977 A1 11/2007 Sakai
2007/0261978 A1 11/2007 Sanderson
2008/0037907 A1 2/2008 Suskind
2008/0077289 A1 3/2008 Fujishima
2008/0142518 A1 6/2008 Maistrellis
2008/0179364 A1 7/2008 Thatcher
2008/0272872 A1 11/2008 Fiedler
2009/0046955 A1 2/2009 Schember et al.
2009/0052810 A1 2/2009 Anda
2009/0078731 A1 3/2009 Yi
2009/0114557 A1 5/2009 Nelson
2009/0184143 A1 7/2009 Witt et al.
2009/0208146 A1 8/2009 Kirby
2010/0025442 A1 2/2010 Shurm
2010/0040307 A1 2/2010 Lien
2010/0140861 A1 6/2010 Kubota et al.
2010/0181220 A1 7/2010 Dasara
2010/0298025 A1 11/2010 Spence
2010/0310194 A1 12/2010 Archambault
2011/0000590 A1 1/2011 Welch et al.
2011/0036473 A1 2/2011 Chan et al.
2011/0150368 A1 6/2011 Ellsworth et al.
2011/0242744 A1 10/2011 Klosky
2011/0317943 A1 12/2011 Russo
2012/0096669 A1 4/2012 Treacy
2012/0111930 A1 5/2012 Maistrellis
2012/0128273 A1 5/2012 Lytle

(56) References Cited

U.S. PATENT DOCUMENTS

| | | | | |
|---|---|---|---|---|
| 2012/0137637 | A1 | 6/2012 | Gillis | |
| 2012/0216374 | A1 | 8/2012 | Manuello | |
| 2013/0032503 | A1 | 2/2013 | Nobile | |
| 2013/0061431 | A1 | 3/2013 | Naftali et al. | |
| 2013/0077897 | A1 | 3/2013 | Li | |
| 2013/0084029 | A1 | 4/2013 | Wang | |
| 2013/0177262 | A1 | 7/2013 | Anzini et al. | |
| 2013/0221048 | A1 | 8/2013 | Revels et al. | |
| 2013/0230260 | A1 | 9/2013 | Maynard et al. | |
| 2013/0242481 | A1 | 9/2013 | Kim et al. | |
| 2013/0243354 | A1 | 9/2013 | Lytle | |
| 2014/0066144 | A1 | 3/2014 | Hong | |
| 2014/0138378 | A1 | 5/2014 | Lequeux | |
| 2014/0138384 | A1 | 5/2014 | O'Brien | |
| 2014/0158558 | A1 | 6/2014 | Ye | |
| 2014/0209011 | A1 | 7/2014 | Byun | |
| 2014/0254956 | A1 | 9/2014 | Buell, III | |
| 2014/0262658 | A1 | 9/2014 | Wegener | |
| 2014/0360892 | A1 | 12/2014 | Lin | |
| 2015/0037799 | A1 | 2/2015 | Takagi | |
| 2015/0076144 | A1 | 3/2015 | Chalifoux | |
| 2015/0225164 | A1 | 8/2015 | Seiders et al. | |
| 2015/0239631 | A1 | 8/2015 | Kinskey | |
| 2015/0305402 | A1 | 10/2015 | Bourgoin | |
| 2016/0021997 | A1 | 1/2016 | Gonzalez | |
| 2016/0023808 | A1 | 1/2016 | Traverso et al. | |
| 2016/0058142 | A1 | 3/2016 | Buynar | |
| 2016/0083147 | A1 | 3/2016 | Mauro | |
| 2016/0130040 | A1 | 5/2016 | Yeh | |
| 2016/0159527 | A1* | 6/2016 | Davison | B65D 33/007 383/33 |
| 2016/0198823 | A1 | 7/2016 | Bergreen et al. | |
| 2016/0221722 | A1 | 8/2016 | Burke et al. | |
| 2016/0235174 | A1 | 8/2016 | Lenci et al. | |
| 2016/0269517 | A1 | 9/2016 | Alexander | |
| 2016/0379184 | A1 | 12/2016 | Smith et al. | |
| 2016/0379185 | A1 | 12/2016 | Smith et al. | |
| 2017/0036844 | A1 | 2/2017 | Seiders et al. | |
| 2017/0066559 | A1 | 3/2017 | Kim et al. | |
| 2017/0174281 | A1 | 6/2017 | Boyd | |
| 2017/0225842 | A1 | 8/2017 | Yeh | |
| 2017/0275056 | A1 | 9/2017 | Boudouris et al. | |
| 2017/0280937 | A1 | 10/2017 | Mogil et al. | |
| 2018/0044094 | A1 | 2/2018 | Seiders et al. | |
| 2018/0148225 | A1 | 5/2018 | Vandamme et al. | |
| 2018/0162626 | A1 | 6/2018 | Munie et al. | |
| 2018/0252458 | A1 | 9/2018 | Furneaux et al. | |
| 2018/0290814 | A1 | 10/2018 | Smith et al. | |
| 2019/0075869 | A1 | 3/2019 | Smith, IV et al. | |
| 2019/0133281 | A1 | 5/2019 | Munie et al. | |
| 2019/0200719 | A1 | 7/2019 | Sullivan et al. | |
| 2019/0202621 | A1 | 7/2019 | Rogers et al. | |
| 2019/0279170 | A1 | 9/2019 | Smith et al. | |
| 2019/0344951 | A1* | 11/2019 | Rogers | A45C 13/1069 |
| 2020/0055636 | A1 | 2/2020 | Hochberg et al. | |
| 2021/0068519 | A1 | 3/2021 | Rogers et al. | |
| 2021/0221591 | A1 | 7/2021 | Huffer | |
| 2022/0106109 | A1* | 4/2022 | Polevoi | B65F 1/062 |

FOREIGN PATENT DOCUMENTS

| | | | |
|---|---|---|---|
| CA | 2137712 | A1 | 6/1996 |
| CA | 170760 | | 7/2017 |
| CH | 686058 | A5 | 12/1995 |
| CN | 2499356 | Y | 7/2002 |
| CN | 3466138 | | 8/2005 |
| CN | 101168090 | A | 4/2008 |
| CN | 201104571 | Y | 8/2008 |
| CN | 201153601 | Y | 11/2008 |
| CN | 101313791 | A | 12/2008 |
| CN | 300906331 | | 4/2009 |
| CN | 101466617 | A | 6/2009 |
| CN | 201274836 | Y | 7/2009 |
| CN | 301000008 | | 9/2009 |
| CN | 301000009 | | 9/2009 |
| CN | 201393583 | Y | 2/2010 |
| CN | 301808202 | | 1/2012 |
| CN | 301985365 | | 7/2012 |
| CN | 302208071 | | 12/2012 |
| CN | 302623610 | | 11/2013 |
| CN | 103584443 | A | 2/2014 |
| CN | 203435847 | U | 2/2014 |
| CN | 302860668 | | 7/2014 |
| CN | 104870324 | A | 8/2015 |
| CN | 103237473 | B | 12/2015 |
| CN | 303514632 | | 12/2015 |
| CN | 105564794 | A | 5/2016 |
| CN | 205512895 | U | 8/2016 |
| CN | 205512896 | U | 8/2016 |
| CN | 205568112 | U | 9/2016 |
| CN | 205597391 | U | 9/2016 |
| CN | 106108308 | A | 11/2016 |
| CN | 304011530 | | 1/2017 |
| CN | 106858960 | A | 6/2017 |
| CN | 304291753 | | 9/2017 |
| CN | 304338166 | | 11/2017 |
| CN | 304351331 | | 11/2017 |
| CN | 304351332 | | 11/2017 |
| CN | 304361367 | | 11/2017 |
| CN | 304383056 | | 12/2017 |
| CN | 304423326 | | 12/2017 |
| CN | 304457891 | | 1/2018 |
| CN | 304457892 | | 1/2018 |
| CN | 304457893 | | 1/2018 |
| CN | 207072528 | U | 3/2018 |
| CN | 304555914 | | 3/2018 |
| CN | 207186216 | U | 4/2018 |
| CN | 207220369 | U | 4/2018 |
| CN | 108112246 | A | 6/2018 |
| CN | 304668083 | | 6/2018 |
| CN | 304713490 | | 7/2018 |
| CN | 304719918 | | 7/2018 |
| CN | 108430255 | A | 8/2018 |
| CN | 304781354 | | 8/2018 |
| CN | 304781362 | | 8/2018 |
| CN | 304782359 | | 8/2018 |
| CN | 304785773 | | 8/2018 |
| CN | 304785791 | S | 8/2018 |
| CN | 304790835 | | 8/2018 |
| CN | 304823679 | | 9/2018 |
| CN | 304854892 | | 10/2018 |
| CN | 108813906 | A | 11/2018 |
| CN | 304877475 | | 11/2018 |
| CN | 304890011 | | 11/2018 |
| CN | 304915313 | | 11/2018 |
| CN | 109068822 | A | 12/2018 |
| CN | 109068893 | A | 12/2018 |
| CN | 304948871 | | 12/2018 |
| CN | 213428763 | U | 6/2021 |
| CN | 213695976 | U | 7/2021 |
| DE | 60104156 | T2 | 8/2005 |
| DE | 202009000499 | U1 | 3/2009 |
| DE | 202013101685 | U1 | 4/2013 |
| DE | 102012020709 | A1 | 4/2014 |
| DE | 202017003399 | U1 | 7/2017 |
| EM | 000164199-0001 | | 7/2004 |
| EM | 000285028-0001 | | 6/2005 |
| EM | 000434253-0001 | | 1/2006 |
| EM | 000596333-0007 | | 10/2006 |
| EM | 001504127-0001 | | 4/2009 |
| EM | 001519406-0001 | | 6/2009 |
| EM | 001133383-0002 | | 1/2010 |
| EM | 001900705-0002 | | 9/2011 |
| EM | 001922204-0001 | | 11/2011 |
| EM | 002047233-0001 | | 5/2012 |
| EM | 002225706-0001 | | 5/2013 |
| EM | 002294322-0002 | | 8/2013 |
| EM | 001294060-0002 | | 10/2013 |
| EM | 001294060-0003 | | 10/2013 |
| EM | 002540948-0003 | | 9/2014 |
| EM | 002541185-0001 | | 9/2014 |
| EM | 002541185-0003 | | 9/2014 |
| EM | 002515247-0001 | | 10/2014 |

(56) References Cited

FOREIGN PATENT DOCUMENTS

| | | | |
|---|---|---|---|
| EM | 002515247-0002 | | 10/2014 |
| EM | 002550715-0002 | | 10/2014 |
| EM | 002630814-0002 | | 2/2015 |
| EM | 002838573-0001 | | 11/2015 |
| EM | 002676536-0001 | | 5/2016 |
| EM | 003117324-0009 | | 5/2016 |
| EM | 003122464-0001 | | 5/2016 |
| EM | 004109049-0001 | | 7/2017 |
| EM | 00530559-0001 | | 7/2018 |
| EM | 005303559-0003 | | 7/2018 |
| EM | 005511102-0001 | | 8/2018 |
| EM | 005511102-0002 | | 8/2018 |
| EM | 005511102-0003 | | 8/2018 |
| EM | 005511102-0004 | | 8/2018 |
| EM | 005618204-0001 | | 8/2018 |
| EM | 005887585-0006 | | 1/2019 |
| EM | 006501607-0001 | | 5/2019 |
| EP | 03922399 | A2 | 6/1999 |
| EP | 1683736 | A2 | 7/2006 |
| EP | 1864916 | A1 | 12/2007 |
| EP | 2571391 | A2 | 3/2013 |
| EP | 2211655 | B1 | 4/2014 |
| EP | 3310678 | B1 | 4/2020 |
| EP | 3634882 | A4 | 3/2021 |
| EP | 3837179 | B1 | 8/2022 |
| FR | 1069996 | A | 7/1954 |
| FR | 1277415 | A | 12/1961 |
| FR | 1545165 | A | 11/1968 |
| FR | 20105616-001 | | 4/2011 |
| GB | 2045117 | | 6/1995 |
| GB | 4012617 | | 10/2009 |
| GB | 2523728 | A | 9/2015 |
| JP | S4971312 | U | 6/1974 |
| JP | S49112604 | U | 9/1974 |
| JP | S49123217 | A | 11/1974 |
| JP | S5145006 | U | 4/1976 |
| JP | S51108919 | U | 8/1976 |
| JP | S5239481 | A | 3/1977 |
| JP | S53161363 | U | 12/1978 |
| JP | S58039009 | A | 3/1983 |
| JP | S59070508 | U | 5/1984 |
| JP | S6076076 | U | 5/1985 |
| JP | S61073224 | U | 5/1986 |
| JP | S62058606 | A | 3/1987 |
| JP | S62134836 | U | 8/1987 |
| JP | S63068865 | U | 5/1988 |
| JP | S63111442 | U | 7/1988 |
| JP | H01126956 | U | 8/1989 |
| JP | 1992074010 | U | 6/1992 |
| JP | H0556809 | A | 3/1993 |
| JP | H06021210 | U | 3/1994 |
| JP | 3003213 | U | 10/1994 |
| JP | H06076076 | U | 10/1994 |
| JP | 199326980 | U | 11/1994 |
| JP | H0679320 | U | 11/1994 |
| JP | H08502427 | A | 3/1996 |
| JP | H9328149 | A | 12/1997 |
| JP | H10127329 | A | 5/1998 |
| JP | 3051283 | U | 8/1998 |
| JP | 3051385 | U | 8/1998 |
| JP | H1126956 | A | 1/1999 |
| JP | H11147572 | A | 6/1999 |
| JP | 3059196 | U | 7/1999 |
| JP | H11269713 | A | 10/1999 |
| JP | 3073772 | U | 12/2000 |
| JP | 3160109 | B2 | 4/2001 |
| JP | 2001267164 | A | 9/2001 |
| JP | 2002507175 | A | 3/2002 |
| JP | 200347517 | A | 2/2003 |
| JP | 2003071978 | A | 3/2003 |
| JP | 2004000355 | A | 1/2004 |
| JP | 3515781 | B2 | 4/2004 |
| JP | 2005335769 | A | 12/2005 |
| JP | 2005343482 | A | 12/2005 |
| JP | 2006123987 | A | 5/2006 |
| JP | 2007319218 | A | 12/2007 |
| JP | 4074010 | B2 | 4/2008 |
| JP | D1355521 | | 4/2009 |
| JP | 3154150 | U | 10/2009 |
| JP | D1376358 | | 12/2009 |
| JP | 2010030644 | A | 2/2010 |
| JP | 2020512281 | A | 4/2010 |
| JP | D2010-8653 | | 12/2010 |
| JP | 2011121631 | A | 6/2011 |
| JP | D2012-551 | | 8/2012 |
| JP | 3179745 | U | 11/2012 |
| JP | 5107522 | B2 | 12/2012 |
| JP | 201356087 | A | 3/2013 |
| JP | D1487395 | | 1/2014 |
| JP | D1500514 | | 6/2014 |
| JP | D1619280 | | 12/2018 |
| KR | 20020046244 | A | 6/2002 |
| KR | 200341520 | Y1 | 2/2004 |
| KR | 200344351 | Y1 | 3/2004 |
| KR | 20070089473 | A | 8/2007 |
| KR | 3020070006269 | | 12/2007 |
| KR | 3020070006271 | | 2/2008 |
| KR | 200452328 | Y1 | 2/2011 |
| KR | 3020100039256 | | 4/2012 |
| KR | 3020120016755 | | 9/2012 |
| KR | 20130134750 | A | 12/2013 |
| KR | 10201473386 | A | 6/2014 |
| KR | 3020140014014 | | 11/2014 |
| TR | 652921-0001 | | 7/2013 |
| TW | 201637950 | A | 11/2016 |
| TW | M581835 | U | 8/2019 |
| WO | 9408541 | A1 | 4/1994 |
| WO | D032527-029 | | 5/1995 |
| WO | D038554-029 | | 2/1997 |
| WO | 0108527 | A1 | 2/2001 |
| WO | 2007071126 | A1 | 6/2007 |
| WO | 2007140916 | A3 | 2/2008 |
| WO | 08025905 | A2 | 3/2008 |
| WO | 11037356 | A3 | 9/2011 |
| WO | 2013132355 | A2 | 9/2013 |
| WO | D082059-001 | | 11/2013 |
| WO | D091354-003 | | 3/2016 |
| WO | 2017125229 | A1 | 7/2017 |
| WO | 2017136754 | A1 | 8/2017 |
| WO | D099344-004 | | 2/2018 |
| WO | D099344-034 | | 2/2018 |
| WO | D099990-006 | | 3/2018 |
| WO | 2018165426 | A1 | 9/2018 |
| WO | D103345-001 | | 4/2019 |
| WO | 2019135922 | A1 | 7/2019 |
| WO | 2020061513 | A1 | 3/2020 |
| WO | 2020181243 | A1 | 9/2020 |

OTHER PUBLICATIONS

Dec. 9, 2022—(AU) Examination Report No. 2—App. No. 2020231415.
Nov. 24, 2022—(CA) Office Action—App. No. 3131600.
Nov. 18, 2022—(EP) Office Action—App. No. 18763122.1.
May 6, 2019—(WO) International Search Report and Written Opinion—App. No. PCT/US2018/066679.
Jun. 19, 2018—(WO) ISR & WO—App. No. PCT/US18/021546.
Feb. 27, 2015—(JP) Office Action—App. No. 2013-510725.
Feb. 27, 2015—(CN) CSR—App. No. CN103237473B.
Jan. 15, 2015—(CN) Office Action—App No. 201180031291.5.
Jun. 6, 2020—(WO) ISR—App. No. PCT/US20/021513.
Apr. 30, 2020—(WO) International Search Report & Written Opinion—PCT/US20/021519.
Oct. 30, 2020—(CN) Office Action—App. No. 201880015578.0.
Oct. 20, 2020—(IP) Office Action—App. No. 2019548313.
Jan. 29, 2021—(EP) Supplementary Search Report—U.S. Appl. No. 18/763,122.
Jun. 9, 2021—(CN) Second Office Action—App. No. 201880015578.0.
B&H, "Clik Elite Schulter Shoulder Bag", First reviewed Aug. 2, 2012. (https://www.bhphotovideo.com/c/product/828772-REG/Clik_Elite_CE733GR_Schulter_Shoulder_Bag_Gray.html/reviews)(Year: 2012).

(56) References Cited

OTHER PUBLICATIONS

Amazon, "F40C4TMP Packable Lunch Bag Work Lunch Box for Men . . . ", First on sale Aug. 4, 2020. (https://www.amazon.com/dp/B08F7S9JJT/)(Year:2020).
Amazon,"AKASO 6L Small Collapsible Cooler Bag for 12 Cans . . . ", First on sale Mar. 19, 2021. (https://www.amazon.com/AKASO-Collapsible-Leakproof-Waterproof-Insulated/dp/B08ZHDTTQD/)(Year:2021).
Oct. 1, 2021—(JP) Decision of Rejection—Appl No. 2019-548313.
May 6, 2020—(WO) Isr & WO—App. No. PCT/US2020/021513.
Apr. 30, 2020—(WO) ISR & WO—App. No. PCT/US2020/021519.
Dec. 7, 2021—(CN) Third Office Action—App. No. 201880015578.0.
Jan. 17, 2022—(EP) Office Action—App. No. 18763122.1.
Amazon, "Insulated Reusable Eco Snack bag . . . ", First on sale Apr. 8, 2020. (https://www.amazon.com/Insulated-Reusable-Sandwich-Insulin-Cooling/dp/B086W5DFGL/?th=1) (Year: 2020).
Amazon, "Ensign Peak Basic Lunch Sack . . . ", First on sale Apr. 12, 2016. (https://www.amazon.com/Ensign-Peak-Basic-Lunch-Black/dp/B01E64H21A/?th=1) (Year: 2016).
Amazon, "AKASO Packable Insulated Lunch Bag . . . ", First on sale Nov. 9, 2021. (https://www.amazon.com/dp/B09K49Q67N/?th=1) (Year: 2021).
Overstock, "Wildkin Zebra Lunch Bag", First reviewed Apr. 23, 2016. (https://www.overstock.com/Luggage-Bags/Wildkin-Zebra-Lunch-Bag/9765841/product.html?option=14691201) (Year: 2016).
May 17, 2022—(CN) First Office Action—App. No. 202080019089.X.
Jul. 7, 2022—(AU) Examination Report No. 1—App. No. 2020231415.
Jul. 9, 2022—(AU) Examination Report No. 1—App. No. 2020232017.
Jun. 9, 2022—(PH) Substantive Examination Report—App. No. 12019501924.
May 25, 2022—(CN) First Office Action—App. No. 202080018671.4.
Oct. 20, 2022—(EP) Office Action w/Partial ESR—App. No. 20716299.1.
Jun. 23, 2022—(MX) First Office Action—App. No. MX/a/2019/010534.
Nov. 14, 2022—(JP) Office Action—App. No. 2021-552871.
Nov. 23, 2022—(CA) Office Action—App. No. 3131599.
Feb. 28, 2023—(JP) Office Action—App. No. 2022-013906.
Mar. 24, 2023—(AU) Examination Report No. 1—App. No. 2018230395.
May 25, 2023—(CN) Decision of Rejection—App. No. 202080019089.X.
May 24, 2023—(CN) Office Action—App. No. 202080018671.4.
May 24, 2023—(JP) Office Action—App. No. 2021552871.
Jun. 13, 2023—(NZ) Office Action—App No. 778976.
Youtube, "How to Sew a Simple Lunch Bag with Hook & Loop Closure", By "DIYDanielle" on Sep. 12, 2016. (https://www.youtube.com/watch?v=3vtidkeCaj0) (Year: 2016).
Etsy Shop "LunchBagShopUA", "Lunch bag insulated gift for him for her for mom lunch box", First review for item Feb. 28, 2018. (https://www.etsy.com/listing/566937249/lunch-bag-insulated-gift-for-him-for-her?ref=reviews) (Year: 2018).
Jan. 18, 2023—(CN) Second Office Action—App. No. 202080019089.X.
Jan. 20, 2023—(CN) Second Office Action—App. No. 202080018671.4.
Jun. 12, 2023—(NZ) Examination Report 1—App. No. 778975.
YETI Daytrip Packable Lunch Bag, first available Jan. 31, 2022. Retrieved from: https://www.amazon.com/ YETI-Daytrip-Packable-Alpine-Yellow/dp/B09RLK9H1P?th=1 on Apr. 25, 2023.
Hydro Flask Insulated Lunch Box, first available Jun. 1, 2022. Retrieved from: https://www.amazon.com/ Hydro-Flask-Insulated-Lunch-Box/dp/B09VM5RWQ7?th=1 on Apr. 25, 2023.
ZENPAC Insulated Lunch Bag, first available Jun. 30, 2020. Retrieved from: https://www.amazon.com/dp/B08BG9Y3G5/ref= sbl_dpx_dining-lunch-bags_B0BSDQ2ZD3_0?th=1 on Apr. 25, 2023.
YETI Hopper Flip 12 Portable Soft Cooler, first available Jan. 31, 2022. Retrieved from https://www.amazon.com/ YETI-Hopper-Portable-Cooler-Alpine/dp/B09RKVPF7G/ on Apr. 25, 2023.
Jul. 4, 2023—(JP) Final Office Action—App. No. 2022-013906.
Jul. 19, 2023—(CN) Office Action—App. No. 202210605876.3.
Aug. 2, 2023—(WO) International Search Report & Written Opinion—PCT/US2023/062537.

* cited by examiner

CONTAINER WITH RESEALABLE CLOSURE

CROSS-REFERENCE TO RELATED APPLICATIONS

This application is related to U.S. application Ser. No. 16/295,682, filed Mar. 7, 2019, U.S. application Ser. No. 16/096,206, filed Oct. 24, 2018, PCT/US18/21546, filed Mar. 8, 2018, and U.S. Provisional Patent Application No. 62/468,673, filed Mar. 8, 2017. All of these applications are incorporated herein by reference in their entirety for any and all non-limiting purposes.

FIELD

The present disclosure relates generally to non-rigid, semi-rigid and rigid portable container devices useful for storing personal belongings in a sealed storage compartment that has a magnetic closure.

BACKGROUND

Containers may be designed to store a user's personal belongings in order to provide a degree of protection from incidental impact (e.g. drops), as well as from liquids and dirt. Containers may be composed of rigid materials such as metal or plastics or flexible materials such as fabric or foams. Containers may be designed with an opening/aperture that allows access to the interior contents of the container. The opening may also be provided with a closure mechanism.

SUMMARY

This Summary provides an introduction to some general concepts relating to this invention in a simplified form that are further described below in the Detailed Description. This Summary is not intended to identify key features or essential features of the invention.

Aspects of this disclosure herein may relate to container devices having one or more of (1) a partial or full waterproof closure and/or (2) a magnetic closure, and a mechanism to keep the container open.

Other aspects of this disclosure may relate to a container, comprising: an outer shell with a front portion, a back portion, and a base portion, the outer shell further comprising: (a) an opening at a top of the container extending into a storage compartment, where the container has an open configuration that allows access to the storage compartment and a closed configuration that prevents access to the storage compartment; and (b) a closure mechanism, further comprising: (1) a first magnetic strip extending along and coupled to an internal surface of the front portion at a front side of the opening; (2) a second magnetic strip extending along and coupled to an internal surface of the back portion at a back side of the opening; (3) a first curved member spaced apart from the first magnetic strip, where the first curved member has a first end, a second end, and a first curved member body extending between the first end and the second end; and (4) a second curved member spaced apart from the second magnetic strip, where the first curved member has a first end, a second end, and a second curved member body extending between the first end and the second end. The first magnetic strip may be magnetically attracted to the second magnetic strip to resealably seal the opening, and the first curved member and the second curved member may prevent the opening from closing when the container is in the open configuration. The first curved member may be formed from a non-metallic material. The first curved member and the second curved member may be configured to flex from a first curved configuration to a second curved configuration when the opening is sealed. When the container is in the closed configuration, a portion of a first upper edge of the first curved member and a portion of a second upper edge of the second curved member may be substantially parallel. The first curved member body may comprise a substantially rectangular cross-sectional shape. In addition, the first curved member may have a curvature with a radius between 120 mm and 160 mm, and may also include a non-metallic coating. In some examples, the first end and the second end of the first curved member may both have rounded corners. The first curved member includes a portion formed from a steel alloy. The first curved member may be received in a first receiver in the front portion, and the second curved member may be received in a second receiver in the back portion. Additionally, the first end and the second end of the first curved member are slidable within the first receiver. The container may also include an inner liner forming the storage compartment, the inner liner having a front portion and a back portion, and an insulating layer positioned between the front portion of the outer shell and the front portion of the inner liner and the insulating layer positioned between the back portion of the outer shell and the back portion of the inner liner. The insulating layer may provide insulation for the storage compartment, where the second curved member is between the insulating layer and the outer shell. The container may also include a flap portion extending from the back portion above the back side of the opening, where the flap portion has a first fastener element and a second fastener element coupled to an external surface of the front portion, where the outer shell is configured to fold to removably couple the first fastener element to the second fastener element. Also, at least one of the first magnetic strip and the second magnet strip may comprise a row of circular magnetic elements spaced apart along a flexible polymer strip. The container may also include a pair of straps coupled to the back portion of the outer shell configured to allow a user to carry the container as a backpack.

Still other aspects of this disclosure may relate to an insulated container that comprises: (a) an outer shell defining a sidewall and a base, the outer shell having a front portion, a back portion, side portions, and a base portion; (b) an inner liner forming a storage compartment, the inner liner having a front portion and a back portion; (c) an insulating layer positioned in between the outer shell and the inner liner, the insulating layer providing insulation for the storage compartment; (d) an opening at a top of the insulating container extending into the storage compartment, the opening having a front side and a back side; and (e) a flap portion extending between a top of the outer shell and the opening. The insulated container may also include a closure mechanism that includes: (1) a first closure element extending along and coupled to the front side of the opening; (2) a second closure element extending along and coupled to the back side of the opening; (3) a first curved member spaced below the first magnetic strip, wherein the first curved member has a first end, a second end, and a first curved member body extending between the first end and the second end; and (4) a second curved member spaced below the second magnetic strip, wherein the first curved member has a first end, a second end, and a second curved member body extending between the first end and the second end.

The first magnetic strip may be magnetically attracted to the second magnetic strip to resealably seal the opening, and the first curved member and the second curved member may prevent the opening from closing when the insulating container is in an open configuration. The flap portion, when folded, may be configured to provide a secondary seal of the opening. In addition, the first curved member may be received in a first receiver in the front portion, and the second curved member may be received in a second receiver in the back portion. The first end and the second end of the first curved member may be slidable within the first receiver. Also, the first curved member may extend along the front portion, and the second curved member may extend along the back portion.

Additional aspects of this disclosure may relate to a container, comprising: (a) an outer shell defining a sidewall and a base, the outer shell having a front portion, a back portion, side portions, and a base portion; (b) an opening at a top of the container extending into a storage compartment, the opening having a front side and a back side, where the container has an open configuration that allows access to the storage compartment and a closed configuration that prevents access to the storage compartment; (c) a flap portion extending between a top of the outer shell and the opening. The container may also include a closure mechanism that includes: (a) a first magnetic strip extending along and coupled to the front side of the opening; (b) a second magnetic strip extending along and coupled to the back side of the opening; (c) a first curved member spaced below the first magnetic strip, where the first curved member has a first end, a second end, and a first curved member body extending between the first end and the second end; and (d) a second curved member spaced below the second magnetic strip, wherein the first curved member has a first end, a second end, and a second curved member body extending between the first end and the second end. When the container is in the closed configuration, a portion of a first upper edge of the first curved member and a portion of second upper edge of the second curved member are substantially parallel. The first magnetic strip may be magnetically attracted to the second magnetic strip to resealably seal the opening, and the first curved member and the second curved member may prevent the opening from closing when the container is in the open configuration. The first curved member may be received in a first receiver in the front portion, and the second curved member may be received in a second receiver in the back portion. The first end and the second end of the first curved member may be slidable within the first receiver. The first curved member may be fixedly attached to the front portion at a central region of the first curved member.

Still other aspects of this disclosure may relate to a closure mechanism comprising: (a) a first closure element positioned at a first side of an opening; (b) a second closure element positioned at a second side of the opening; (c) a first curved member, where the first curved member has a first end and a second end, and a first curved member body extending between the first end and the second end; and (d) a second curved member, where the first curved member has a first end and a second end, and a second curved member body extending between the first end and the second end. The first fastening element and the second fastening element together may resealably seal the opening, and the first curved member and the second curved member may be configured to maintain the opening in an open configuration. The first curved member body may comprise a substantially rectangular cross-sectional shape and include a portion formed from a steel alloy. The first curved member may also include a non-metallic coating, where the first end and the second end of the first curved member both have rounded corners. Additionally, the first curved member may be received in a first receiver in the first side of the opening, and the second curved member may be received in a second receiver in the second side of the opening. Both the first curved member and the second curved member may flex from a first curved configuration for maintaining the opening in the open configuration to a second curved configuration when the opening is sealed or in a closed configuration. When the first curved member and the second curved member may be substantially parallel when in the closed configuration.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

Figure 1:
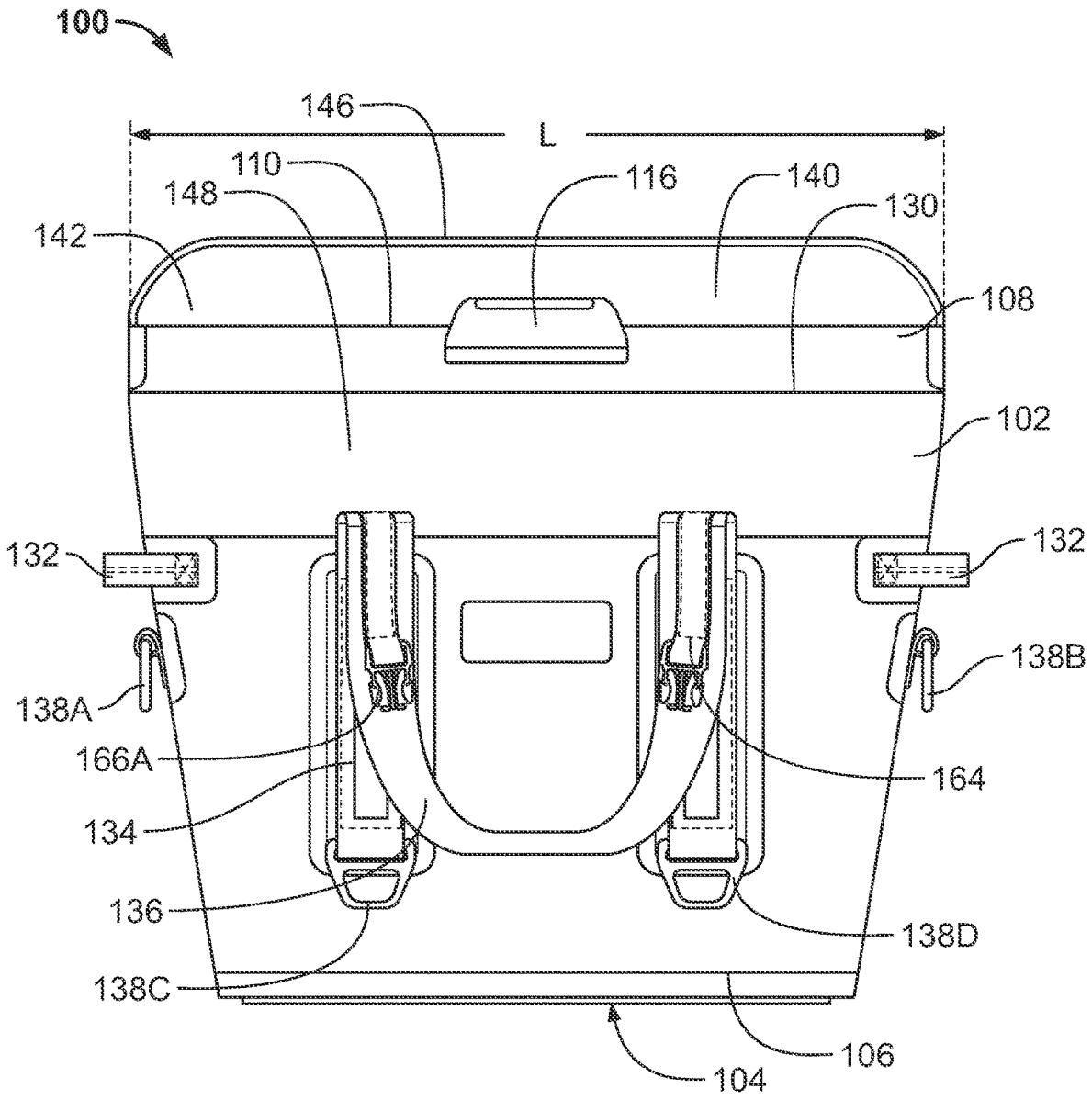
FIG. 1 depicts a front view an exemplary insulating container that can be configured to keep contents cool or warm for an extended period of time, according to one or more aspects described herein.

Further, it is to be understood that the drawings may represent the scale of different components of various examples; however, the disclosed examples are not limited to that particular scale. Further, the drawings should not be interpreted as requiring a certain scale unless otherwise stated.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "frontside," "backside," "front," "back," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

The term "substantially aligned" as used herein may be defined as two items (i.e., edges, surfaces, or centerlines) being within a range of +/−4 mm of each other. In addition, the term "substantially parallel" as used herein may be defined as two items (i.e. edges, surfaces, or centerlines) being within a range of +/−5 degrees of each other.

In the description that follows, reference is made to one or more container structures. It is contemplated that any of the disclosed structures may be constructed from any polymer, composite, and/or metal/alloy material, without from the scope of these disclosures. Additionally, it is contemplated that any manufacturing methodology may be utilized, without departing from the scope of these disclosures. For example, one or more welding (e.g. high frequency, ultrasonic welding, or laser welding of fabric, or metal/alloy welding), gluing, stitching, molding, injection molding, blow molding, stamping, deep-drawing, casting, die-casting, drilling, deburring, grinding, polishing, sanding, or etching processes, among many others, may be utilized to construct of the various containers described throughout these disclosures. Additionally, where reference is made to a magnetic element or structure throughout these disclosures, it may be assumed that the element or structure includes one or more magnets (e.g. permanent magnets), or one or more metals or alloys (e.g. ferromagnetic materials, among others), which may be attracted to magnets. Further, a magnetic strip, as described herein, may include a continuous magnetic element, a series of two or more discrete magnetic elements, or a two- or three-dimensional array of magnetic elements. Additionally, these magnetic elements may be constructed from any magnetic metal or alloy, and may be combined with one or more non-magnetic materials, such as polymers, ceramics, or non-magnetic metals or alloys. It is also contemplated that the various disclosures described in this document may be combined in any manner, such that various permutations of combined elements may be possible.

Various magnetic closure mechanisms are described throughout the following disclosures. These magnetic closure mechanisms may be configured to be partially or fully watertight and/or airtight. It is contemplated that the magnetic closure mechanisms may include gaskets and seals in addition to the described magnetic elements, without departing from the scope of these disclosures.

It is contemplated that any of the containers discussed throughout this document may be partially or fully water-tight, airtight, and/or sealed to substantially or fully prevent dust or other materials from entering into and/or escaping from the containers. For example, containers 100 and/or 200, which are described in further detail in the proceeding paragraphs, may include partially or fully water resistant outer shells/outer walls and closure mechanisms.

Figure 2:
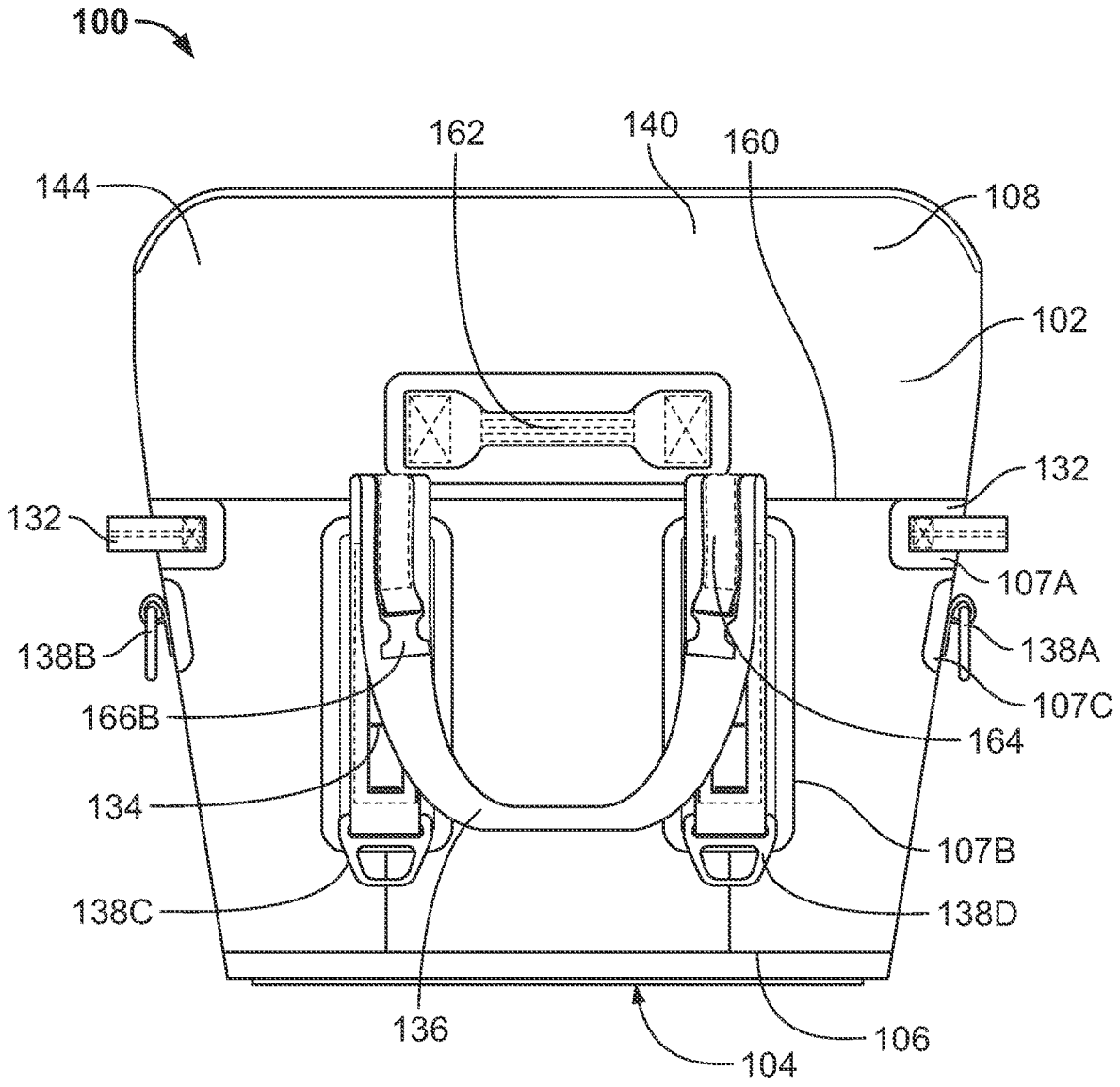
FIG. 2 depicts a back view of the exemplary insulating container of FIG. 1, according to one or more aspects described herein.
Figure 4:
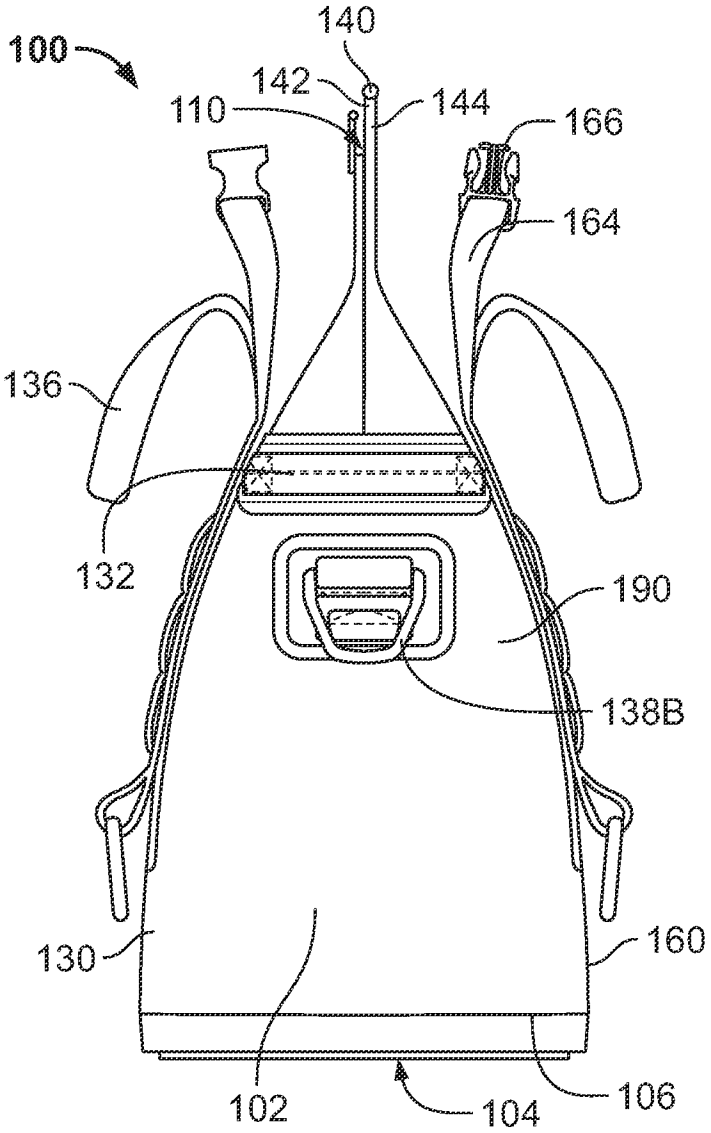
FIG. 4 depicts a right side view of the exemplary insulating container of FIG. 1, according to one or more aspects described herein.
Figure 3:
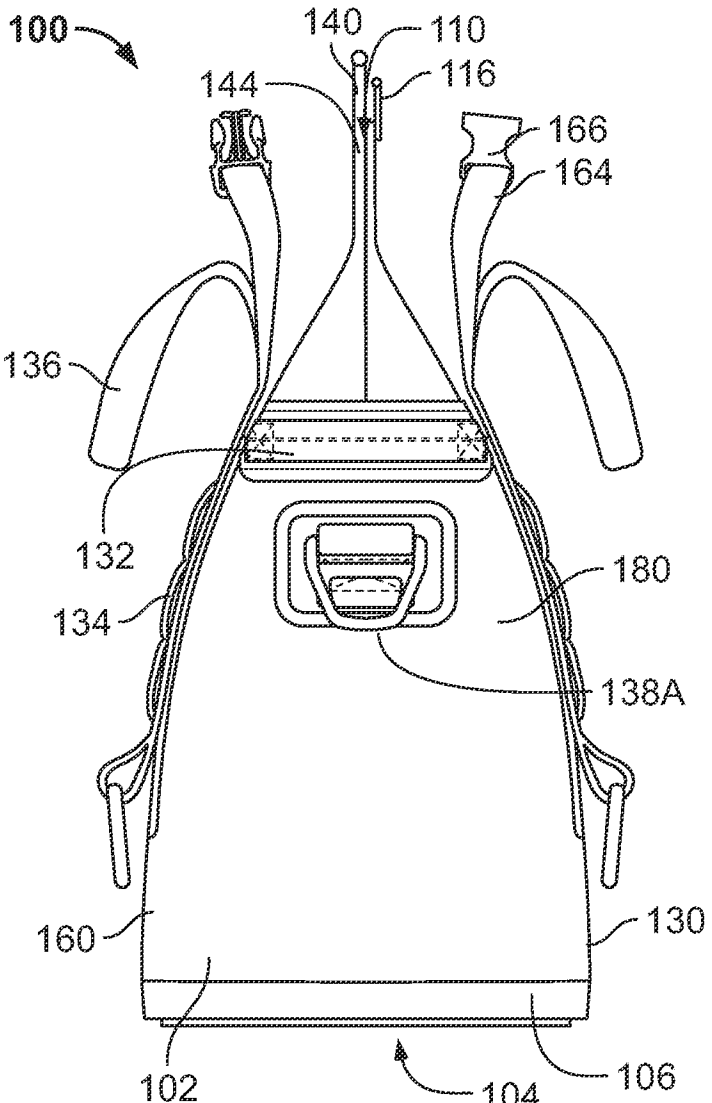
FIG. 3 depicts a left side view of the exemplary insulating container of FIG. 1, according to one or more aspects described herein.

FIG. 1 depicts a front view an exemplary insulating container 100 that can be configured to keep contents cool or warm for an extended period of time. The insulating container 100 may include elements similar to those described in U.S. Pat. No. 10,143,282, issued on Dec. 4, 2018 and filed 6 Mar. 2017, the entire contents of which are incorporated herein by reference in their entirety for any and all non-limiting purposes. FIG. 2 depicts a back view of the insulating container 100, and FIGS. 3-4 depict side views of the insulating container 100. The insulating container 100 generally includes an outer shell 102 that defines a front portion 130, a back portion 160, a left side portion 180, a right side portion 190, and a base 104. In one example, the front portion 130, the back portion 160, and the side portions 180, 190 may collectively be referred to as the sidewall of the container 100. The container 100 additionally includes an opening 110 at a top portion of the container and may include a flap portion 140 that extends above the opening from one or both sides of the front portion 130 or back portion 160. Accordingly, the flap portion 140 is configured to extend above a top of the outer shell 102, and the opening 110. The opening 110 is configured to provide a resealable point of entry into a storage compartment 120 of the container 100. The storage compartment is shown in further detail in FIG. 5. In one example, the opening 110 may include a front side 112 coupled to the front portion 130 and a back side 114 coupled to the back portion 160. The opening 110 may be resealably sealed by closure mechanism 200, where the container 100 may have an open configuration that allows access to the storage compartment 120 and a closed configuration that prevents access to the storage compartment 120. The opening 110 may additionally include a pull tab 116, which is configured to be manually gripped to pull the front and back sides 112 and 114 away from one another to unseal the opening 110. In some examples, the container 110 may include two pull tabs 116 such that a pull tab 116 is arranged on each side of the opening 110.

Figure 6A:
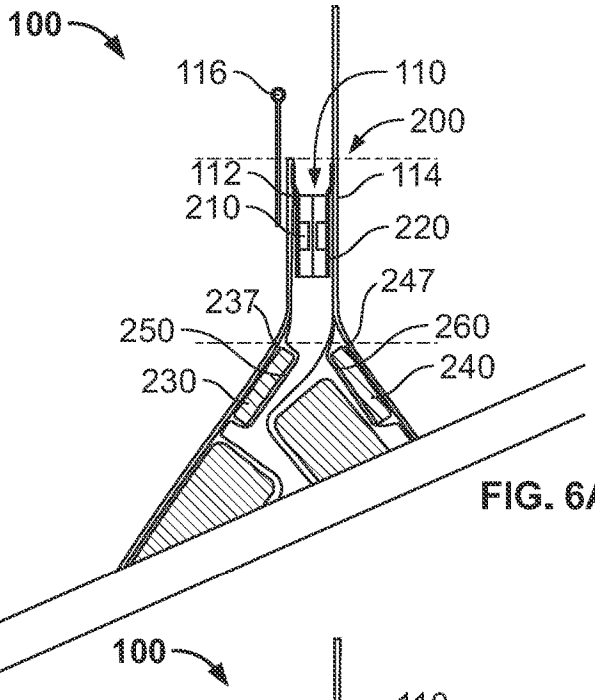
FIGS. 6A-6B schematically depict an enlarged cross-sectional side view of the insulating container of FIG. 5, according to one or more aspects described herein.
Figure 6B:
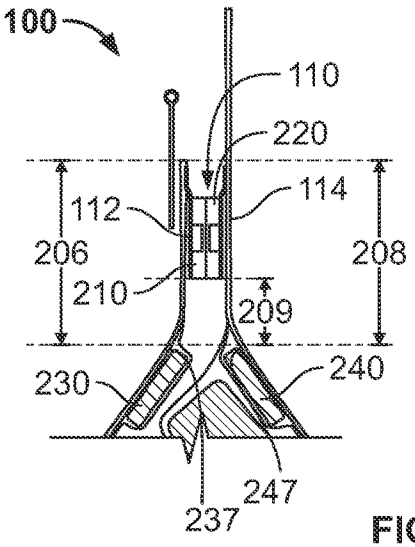
Figure 5:
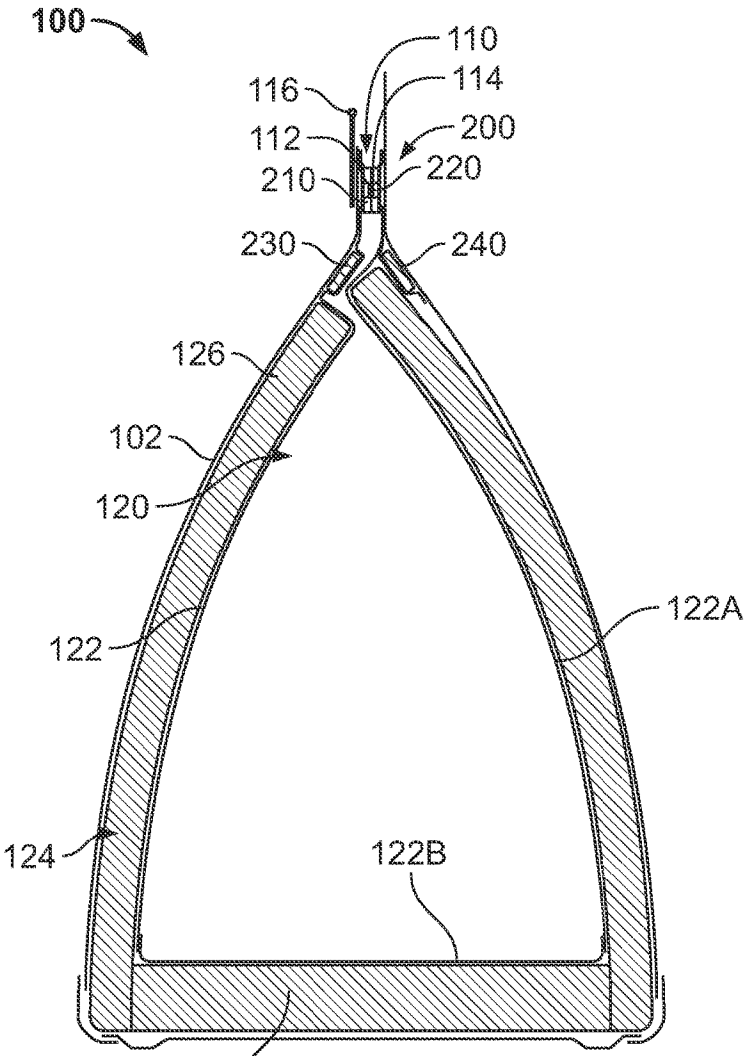
FIG. 5 schematically depicts a view of the exemplary insulating container of FIG. 1, according to one or more aspects described herein.

As shown in FIGS. 5, 6A, and 6B, the closure mechanism 200 may include a first closure or fastening element 210, a second closure or fastening element 220, a first curved member 230, and a second curved member 240. The closure elements 210, 220 may be releasable closure elements such as hook and loop fasteners, mechanical snaps, an interlocking closure of elements where a plug on one closure element fits into a groove and an opposing closure element to form a waterproof seal, magnetic strips, or other releasable closure elements known to one skilled in the art. In some examples, the closure mechanism 200 may include a magnetic strip 210, a magnetic strip 220, a first curved member 230, and a second curved member 240. The first magnetic strip 210 may extend along and be coupled to an internal surface of the front portion 130 at a front side 112 of the opening 110, and the second magnetic strip 220 may extend along and be coupled to an internal surface of the back portion 160 at a back side 114 of the opening 110. The first magnetic strip 210 may be magnetically attracted to the second magnetic strip 220 to resealably seal the opening 110 to keep the container 100 in a closed configuration. The first curved member 230 may extend along an internal surface of the front portion 130 and be spaced by a predetermined distance 206 below the first magnetic strip 210. In one example, the predetermined distance 206 between the first magnetic strip and the first curved member 230 may be approximately 49 mm or within a range of 40 and 60 mm, where the predetermined distance 206 is defined along from an upper edge of the first magnetic strip 210 to an upper edge 237 of the first curved member 230. Similarly, the second curved member 240 may extend along an internal surface of the back portion 160 and be spaced a predetermined distance 208 below the second magnetic strip 220. In one example, the predetermined distance 208 between the second magnetic strip 220 and the second curved member maybe approximately 46 mm from the first magnetic strip 210, or within a range of 40 and 60 mm, where the predetermined distance 208 is defined along from an upper edge of the second magnetic strip 220 to an upper edge 247 of the second curved member 240. Additionally, a gap or spacing 209 between a lower edge a magnetic strip 210, 220 and an upper edge 237, 247 of the curved members 230, 240 may be approximately 16 mm, or within a range of 12 and 28 mm to allow the flap portion 140 to fold between the magnetic strips 210, 220 and the curved members 230, 240. However, because of the curvature of the front portion 130 and the back portion 160 of the upper edge 237 of the first curved member 230 may be substantially aligned with the upper edge 247 of the second curved member 240. The first curved member 230 may be secured in a front receiver 250 of the front portion 130 of the container 100, and the second curved member 240 may be secured in a back receiver 260 of the back portion 160 of the container 100. When in the closed configuration, the first and second magnetic strips 210, 220 may be substantially aligned with each other, and the first and second curved members 230, 240 may be substantially aligned. Alternatively, the curved members 230, 240 may extend along and be coupled to an exterior surface of the front and back portions 130, 160 respectively. As an example, the receivers 250, 260 may be located along an exterior surface of the outer shell 102. Once a user moves the container 100 to an open configuration by separating the first and second magnetic strips 210, 220, the first and second curved members 230, 240 may act to prevent the container 100 from closing and hold (or maintain) the container 100 in an open configuration. Optionally, the closure mechanism 200 may have only a single curved member 230 or 240 arranged on only one side of the closure (e.g., a single curved member 230 along the front portion 130 of the container 100, or a single curved member 240 along the back portion 160 of the container 100).

The first and second curved members 230, 240 may exert spring forces in an opposite direction to the magnetic forces that act between the first magnetic strip 210 and the second magnetic strip 220 to prevent the opening 110 of the container 100 from accidentally closing, and these opposing forces may also allow the opening 110 to move from an open configuration to a closed configuration in a controlled manner. The closure mechanism 200 moving from an open configuration to a closed configuration in a slow and controlled manner may prevent any injury to a user from the closure mechanism 200 closing too quickly and provide a safe and effective sealing mechanism.

Figure 8A:
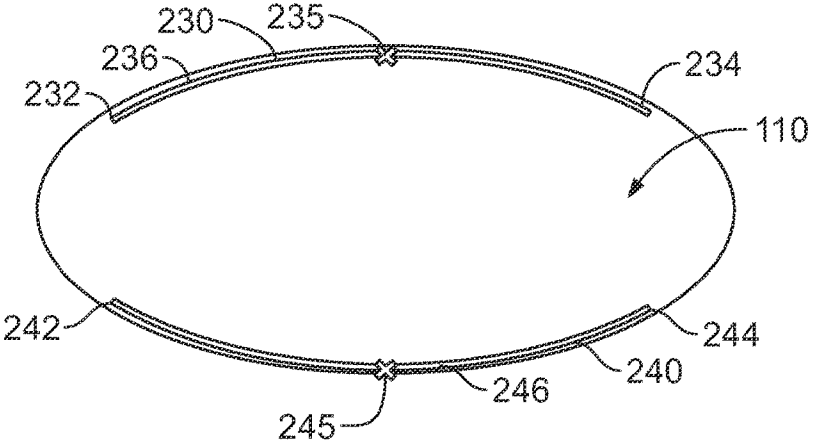
FIGS. 8A-8C schematically depict top views of the exemplary curved members of the insulating container of FIG. 1 as the insulating container moves from an open configuration and a closed configuration, according to one or more aspects described herein.
Figure 8B:
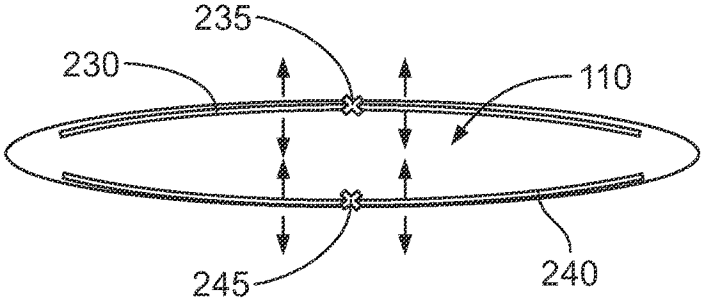
Figure 8C:
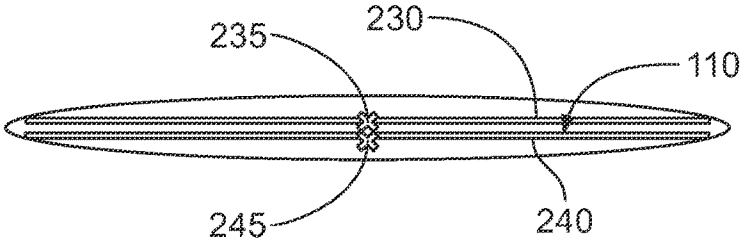
Figure 8D:
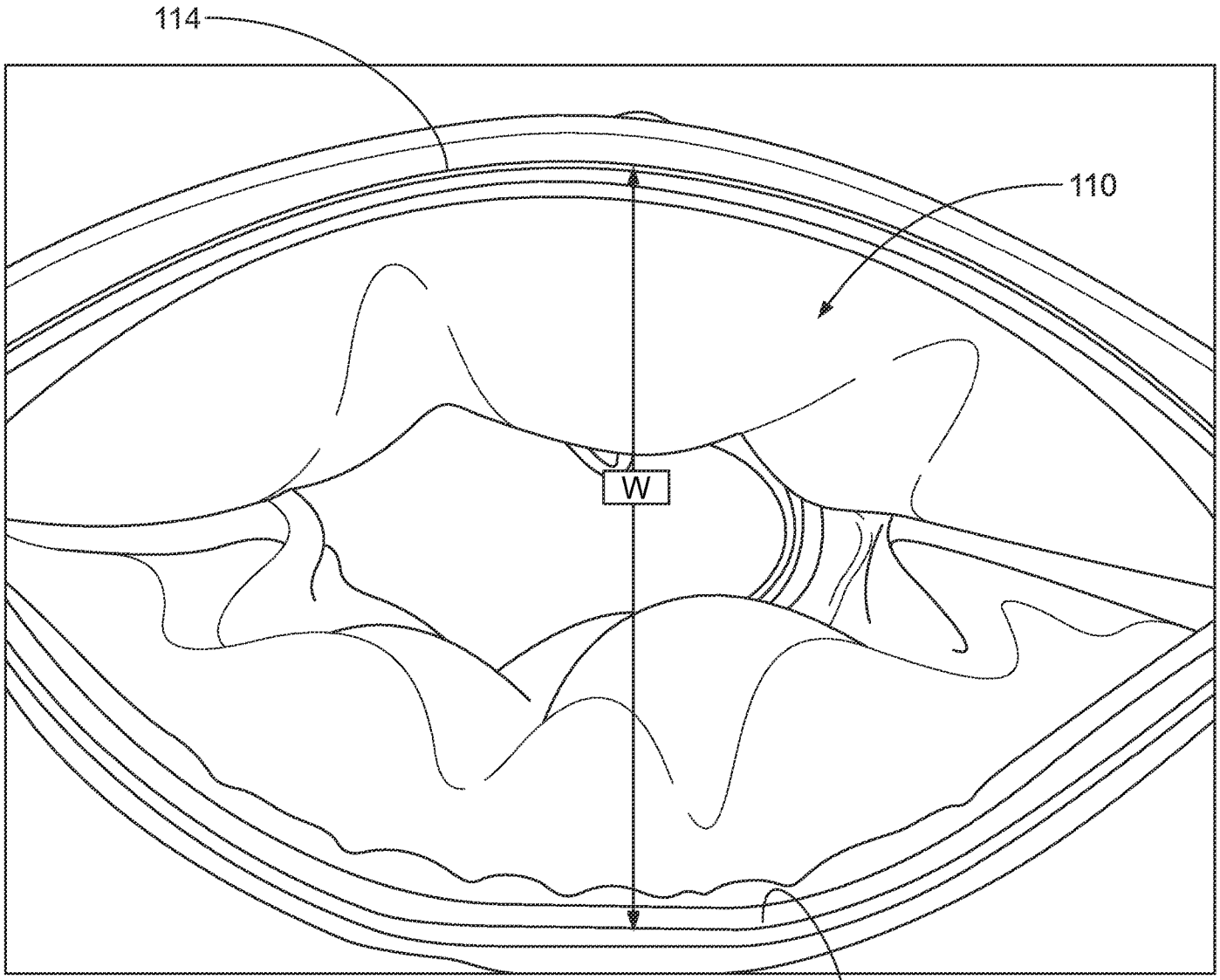
FIG. 8D depicts a top perspective view of the insulating container of FIG. 1 in an open configuration, according to one or more aspects described herein.

In particular, the curved members 230, 240 may provide spring forces that act against the magnetic forces of the magnetic strips 210, 220. The curved members 230, 240 may be formed with a curved profile with a concave contour that faces the opening 110 of the container 100. The first curved member 230 may have a first end 232, a second end 234, and a curved member body 236 that extends between the first end 232 and the second end 234. Similarly, the second curved member 240 may have a first end 242, a second end 244, and a curved member body 246 that extends between the first end 242 and the second end 244. In addition, the curved members 230, 240 may be fixedly attached to the front portion 130 and back portion 160 at the curved members 230, 240 respective attachment points 235, 245 that may be located at or near a center of each curved member 230, 240. Each end 232, 234, 242, 244 may be free to move and slide within their respective receivers 250, 260 as the curved members 230, 240 may deform or flex during the opening and closing process. When the opening 110 is in an open configuration, as schematically shown in FIG. 8A, the curved members 230, 240 are in an undeformed state or substantially undeformed state (i.e., the curved members 230, 240 have their original curved profile shape or a first curved configuration). As shown in FIG. 8D, the width, W, or size of the opening 110 may be defined as a distance measured at the center of the opening 110 in a direction from the front side 112 to the back side 114. In some examples, the width, W, of the opening, when the container 100 is in the open configuration, may be approximately 7 inches, or may be within a range of 6 inches and 9 inches. When a user applies a force to move the opening 110 towards a closed configuration, as shown in FIG. 8B, the magnetic forces between the magnetic strips 210, 220 begin pulling the front side 112 toward the back side 114 of the opening 110, while simultaneously, the curved members 230, 240 begin exerting spring forces pulling the front side 112 and the back side 114 away from each other. These opposite forces cause the opening 110 to close in a slow and controlled manner. At one point, the forces reach a bifurcation distance where the opening 110 is opened at its center to a distance, where the magnetic forces between the magnetic strips 210, 220 and the spring forces between the curved members 230, 240 are balanced. Additionally, when the width, W, of the opening 110 is open a distance greater than the bifurcation distance, the spring forces may be greater than the magnetic forces to keep the opening 110 in an open configuration as shown in FIG. 8A. When the width, W, of the opening 110 is open a distance less than the bifurcation distance, the magnetic forces may be greater than the spring forces and as the width, W, of the opening 110 decreases beyond the bifurcation distance the magnetic forces increase at a faster rate than the spring forces causing the opening to move and stay in the closed configuration as shown in FIG. 8C. As the opening 110 moves from an open configuration to a closed configuration, the first curved member 230 and the second curved member 240 move from a first curved configuration when the opening is in an opened configuration to a second curved configuration when the bag is in the closed configuration. But the second curved configuration is such that the curved members 230, 240 may be substantially parallel. In some examples, when in the closed configuration, portions of the upper edges 237, 247 of the curved members 230, 240 may be substantially parallel to each other, or in some cases, a majority of the first curved member 230 may be substantially parallel with a majority of the second curved member 240. In other examples, when in the closed configuration, the curved members 230, 240 may have some regions that are not parallel to each other.

Figure 9:
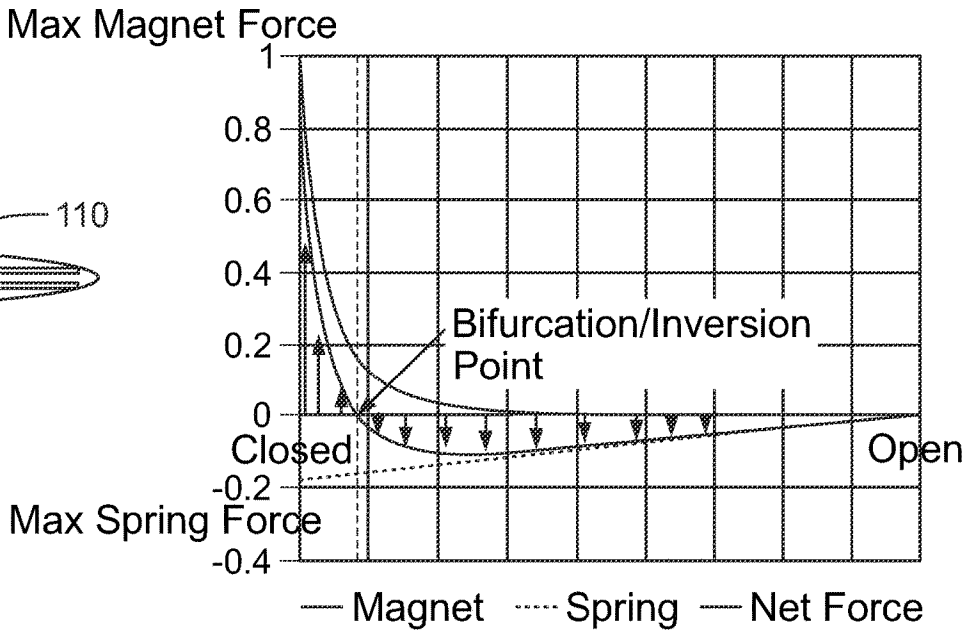
FIG. 9 depicts a graph of magnetic and spring forces during opening and closing of the container, according to one or more aspects described herein.

The magnetic and spring forces exerted on the opening 110 in various configurations are illustrated in FIG. 9. FIG. 9 illustrates that the magnetic forces obey the inverse square law where the magnetic forces increase as a relationship that is inversely proportional to the distance between the first and second magnetic strips 210, 220 squared (i.e., $F \alpha 1/d^2$), whereas the spring forces from the curved members 230, 240 increase linearly as the curved shape of each curved member 230, 240 is deformed into a substantially linear or straight shape as shown in FIG. 8C. When the opening 110 is in the closed configuration, the curved members 230, 240 are in a deformed state or a second curved configuration (i.e., may be deformed to almost a linear shape or may have a minimal curvature that is reduced from the curvature of the first curved configuration), which exerts a spring force that is linearly proportional to the amount of deformation of each curved member 230, 240. As discussed above, when the curved members 230, 240 are in a deformed state (or second curved configuration), the curved members 230, 240 may be substantially parallel. When the opening 110 is in a closed configuration, the distance between the magnetic strips 210, 220 is minimal or zero, because the magnetic strips 210, 220 may contact each other, which results in the magnetic forces being greater than the spring forces exerted by the curved members 230, 240. When the opening 110 is open to width, W, that equals the bifurcation distance, the spring forces and the magnetic forces are equal. As discussed above, when the width, W, is greater than the bifurcation distance the spring forces may be greater than the magnetic forces, and when the width, W, is less than the bifurcation distance the magnetic forces may be greater than the spring forces. When the opening 110 is in an open configuration, the curved members 230, 240 may be in their undeformed state, which results zero spring force acting on the opening 110, but the center distance (i.e., width, W) of the opening 110 is large enough such that the magnetic forces from the magnetic strips 210, 220 are not strong enough to overcome any spring forces that may be generated by even a slight deformation of the curved members 230, 240. Thus, the opening 110 is prevented from closing without being acted upon by an external force such as a push from a user.

Figure 30:
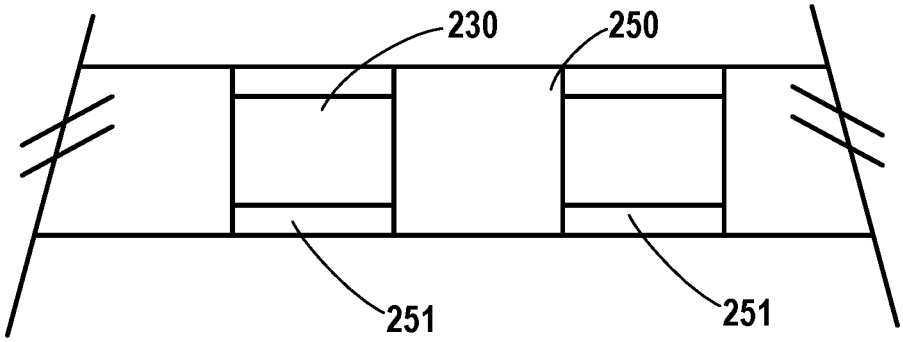
FIG. 30 depicts a schematic view of an exemplary curved member within an intermittent receiver of the insulating container of FIG. 1, according to one or more aspects described herein.

FIGS. 5, 6A, and 6B schematically depict a cross-sectional side view of the insulating container 100. As shown in FIGS. 5, 6A and 6B, the magnetic strips 210, 220 may be located at the opening 110, and the curved members 230, 240 may be spaced below their respective magnetic strips 210, 220. In the illustrated example, an inner liner 122 forms a chamber, receptacle, or storage compartment 120 for receiving and storing contents therein. The insulating container 100 may include an inner liner 122, an insulating layer 124, and an outer shell 102. The insulating layer 124 may be located between the inner liner 122 and the outer shell 102, and may be formed as a foam insulator to assist in maintaining the internal temperature of the storage compartment 120 for storing contents desired to be kept cool or warm. In addition, the first curved member 230 may be positioned between the inner liner 122 and the outer shell 102. As shown in FIGS. 5, 6A, and 6B, the back curved member 240 may be located between the insulating layer 224 and the outer shell 102. In addition, the front receiver 250 and back receiver 260 may be formed to secure the curved members 230, 240 on all sides such that the curved members 230, 240 are sealed within the receivers 250, 260 respectively. The curved members 230, 240 may be slid into their respective receivers 250, 260 before ends of the receivers 250, 260 are sealed. The receivers 250, 260 may be formed from the same material as the inner liner 122 or from a similar material as known to one skilled in the art using a welding process to join the receivers 250, 260 to container 100. As discussed above, a center portion of the curved members 230, 240 may be fixedly attached to the respective front and back portions 130, 160 to allow the ends of each curved member 230, 240 to move freely. Alternatively or optionally, the curved members 230, 240 may not be fixedly attached at any point or multiple points and be allowed to move or slide freely within their respective receivers 250, 260. For example, the curved members 230, 240 may be partially or fully contained within their respective receivers 250, 260 and may be fixedly attached in some examples at multiple positions, such as near the center and near each end. In addition, each receiver 250, 260 may be continuous and free of openings, or one or both of the receivers 250, 260 may be intermittent with one or more openings 251 that expose the respective curved member to the interior of the container 110 as shown in FIG. 30. The openings 251 may be evenly spaced apart or alternatively unevenly spaced apart. In one example, both of the curved members 230, 240 may be located between the insulating layer 124 and the outer shell 102, or in another example, neither of the curved members 230, 240 may be located between the insulating layer 124 and the outer shell 102. In some examples, the insulating layer 124 adjacent the back portion 160 of the container 100 may have an upper end that is higher than an upper end of the insulating layer 124 adjacent the front portion 130. In these examples, the upper portion of the insulating layer 124 adjacent the back portion 160 may be skived or tapered to the closure mechanism 200 operate smoothly.

Figure 31:
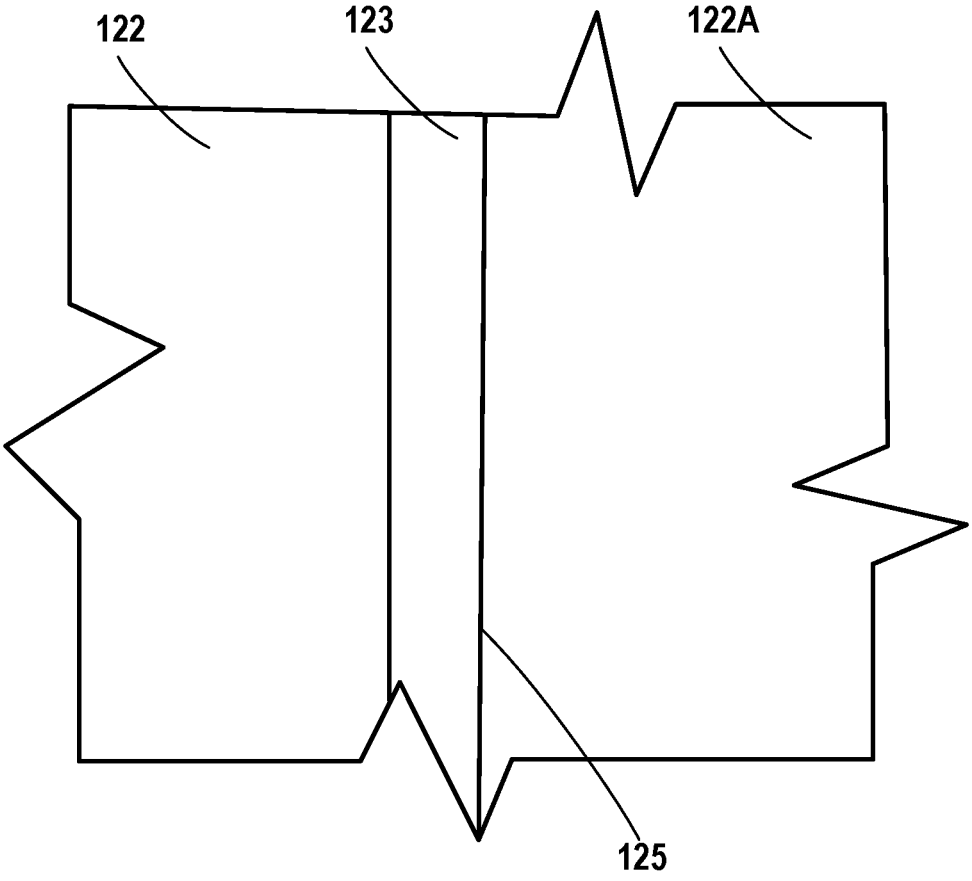
FIG. 31 depicts a schematic view of an exemplary liner seam of the insulating container of FIG. 1, according to one or more aspects described herein.

The insulating layer 124 may be located in between the inner liner 122 and the outer shell 102, and may be unattached to either the inner liner 122 or the outer shell 102 such that it floats between the inner liner 122 and the outer shell 102. In one example, the inner liner 122 and the outer shell 102 may be connected at a top portion 108 of the insulating container 100 such that the insulating layer 124 may float freely within a pocket formed by the inner liner 122 and the outer shell 102. The inner layer or inner liner 122 can be formed of a first inner liner sidewall portion 122A and a bottom inner liner portion 122B. The first inner liner sidewall portion 122A and the bottom inner liner portion 122B can be secured together by, for example, welding, to form the storage compartment 120. In some examples, the storage compartment 120 may be a "dry bag," or vessel for storing contents. In one example, a tape, such as a TPU tape, can be placed over the seams to help join and seal the sections of the storage compartment 120 after the sections of the storage compartment 120, after the first inner liner sidewall portion 122A and the bottom inner liner portion 122B are secured or joined together. As another option, a tape or other film 123, such as a TPU tape, may be wrapped around an edge 125 of a first inner liner sidewall portion 122A, such that the tape is wrapped along both sides of the edge 125 of the first inner liner sidewall portion 122A and then welded to a second inner liner sidewall portion 122A to seal the fibrous edge 125 of the first inner liner sidewall portion 122A with the second edge of the liner sidewall portion 122A as shown in FIG. 31. The welded joint may be a lap joint or butt joint. The tape 123 may be wrapped around one or both of the edges 125 of the liner sidewall portion to be joined. In some examples, both edges may have tape 123 wrapped along the edges of both inner liner sidewall portions. The tape may also be used seals the seams formed between the first inner liner sidewall portion 122A and the bottom inner liner portion 122B to provide an additional barrier to liquid to prevent liquid from either entering or exiting the storage compartment 120. The inner liner 122 can, thus, either maintain liquid in the storage compartment 120 of the insulating container 100 or prevent liquid contents from entering into the storage compartment 120 of the insulating container 100. It is also contemplated, however, that the inner liner 122 may be formed as an integral one-piece structure that may be secured within the outer shell 102. The liner material may comprise a thermoplastic polyurethane (TPU), thermoplastic elastomer (TPE), thermoplastic copolyester elastomers (TPC), or other materials known to one skilled in the art.

Figure 7A:
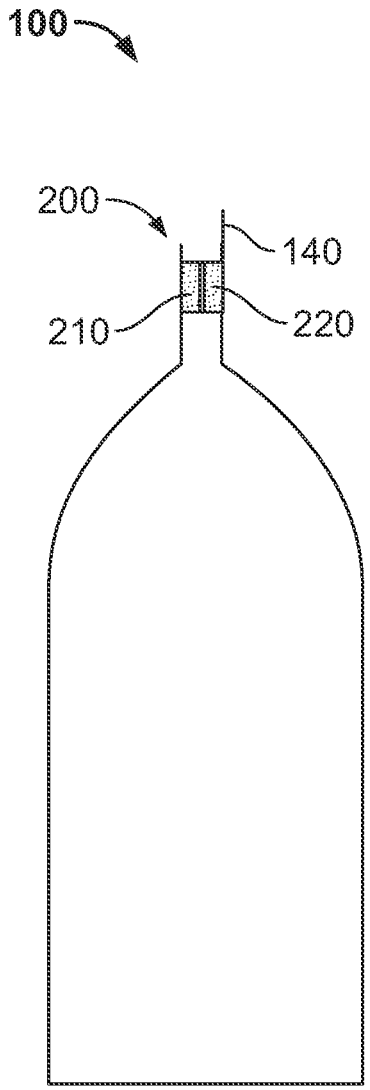
FIGS. 7A-7B schematically depict cross-sectional views of an insulating container in respective unfolded and folded configurations, according to one or more aspects described herein.
Figure 7B:
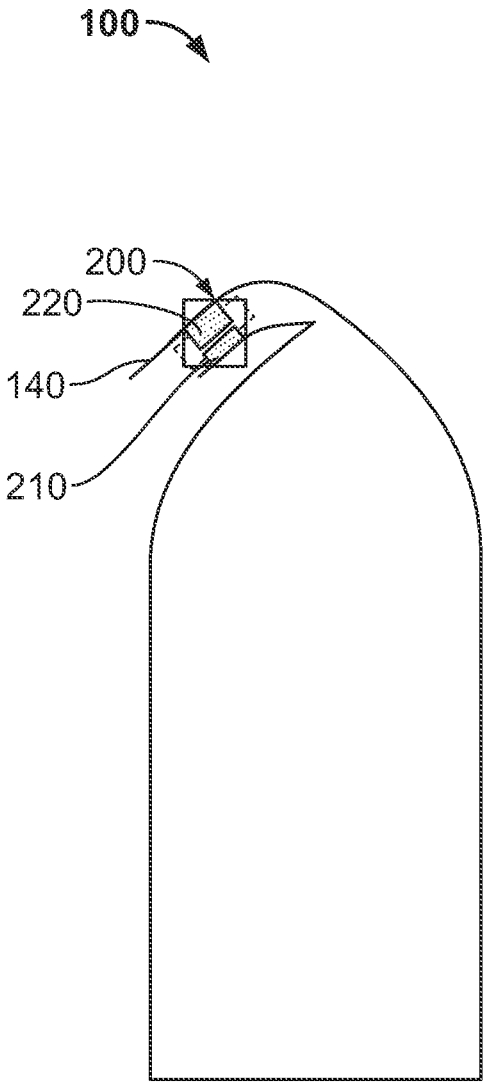

In one example, the closure mechanism 200 used to seal the opening 110 may be substantially waterproof or water resistant and prevent or reduce liquid ingress into and/or egress from the insulating container 100. Further, the flap portion 140 may be folded to further seal the opening 110 as shown in FIGS. 7A-7B. The flap portion 140 may fold between the magnetic strips 210, 220 and the curved members 230, 240.

Referring back to FIGS. 1 and 2, various handles, straps or loops, and webs (e.g., 132, 134, 136) may also be included on the insulating container 100 for carrying, holding, or securing the insulating container 100. In this regard, the outer shell 102 can also include multiple reinforcement areas or patches, e.g., 107A-107C that are configured to assist in structurally supporting the optional handles or straps (e.g., 132, 134, 136, 162). These reinforcement areas or patches may be located on an inner or outer surface of the outer shell 102. The handles or straps (e.g., 132, 134, 136, 162) and other attachments may be stitched, glued, welded or riveted, or attached using any other attachment methodology, or combination of methodologies, to the main structure of the insulating container 100.

The insulating the container 100 may include two carry handles 136 that are connected to the front portion 130 of the insulating container 100 and the back portion 160 of the insulating container 100. In one example, a shoulder strap can be attached to attachment rings 138A, 138B. The insulating container 100 may additionally include side handles 132 to facilitate carrying of the insulating container 100. Additionally, webbing formed as loops 134 may be sewn onto or otherwise attached to the straps of the handles 136. The loops 134 can be used to attach items (e.g., carabineers, dry bags) to the insulating container 100. In one example, the carry handles 136, side handles 132, and loops 134 may be constructed of nylon webbing. Other materials may include, among others, polypropylene, neoprene, polyester, Dyneema, Kevlar, cotton fabric, leather, plastics, rubber, or rope.

In one example, the rings 138A-138D may be Acetal (POM) D-rings. The attachment rings 138A-138D may be constructed from one or more polymers, metals, ceramics, glasses, alloys, or combinations thereof. In certain specific examples, the attachment rings 138A-138D may be constructed from nylon, polypropylene, neoprene, polyester, Dyneema, and Kevlar, cotton fabric, leather, plastics, rubber, or rope. In some examples, the attachment rings 138A-138D may include some amount of recycled material. The attachment rings 138A-138D may include other shapes, sizes, and configurations other than the depicted "D" shape. Examples include round, square, rectangular, triangular, or rings with multiple attachment points.

FIG. 1 further depicts a base 104 and a base support ridge 106. The base support ridge 106 may provide structural integrity and support to the insulating container 100 (also referred to as an insulating device 100) when the insulating container 100 is placed onto a surface.

The flap portion 140 may have a front side 142 and a back side 144. Further, in one implementation, the flap portion 140 may be configured to fold such that a top flap portion 146 folds over onto a bottom flap portion 148. When folded, the top flap portion 146 may be removably coupled to the bottom flap portion 148 by a secondary closure mechanism. In one example, both of the top flap portion 146 and the bottom flap portion 148 may include magnetic elements (e.g., permanent magnets and magnetic materials) that are embedded within the container 100 along the length, L, of the opening 110. In one example, a single magnetic strip may be embedded in one or more of the top flap portion 146 and the bottom flap portion 148 and extend along at least a portion of the length of 106. In some examples, a top flap portion 146 may be taller than the bottom flap portion 148, or in some examples, the top flap portion 146 may have the same height as the bottom flap portion 148. Additionally or alternatively, a series of one or more discrete magnetic elements may be embedded in one or more of the top flap portion 146 and the bottom flap portion 148 and extend along at least a portion of the length, L. In other implementations, hook and loop fasteners, or other fastener types, may be used in combination with or as an alternative to magnetic fasteners to removably couple the top flap portion 146 and the bottom flap portion 148 to one another.

In the illustrated example, the flap portion 140 may be folded wherein the top flap portion 146 may be held in a folded configuration by buckles and straps that extend over the top of the container 100 between the back portion 160 and the front portion 130. Strap 164 and fastener element or buckle 166A, which may be coupled to the carry handle 136 on the front portion 130, may be utilized to hold the top flap portion 146 in a folded configuration when removably coupled to a corresponding fastener element or buckle 166B coupled to the carry handle 136 of the back portion 160 of the container 100.

Figure 10:
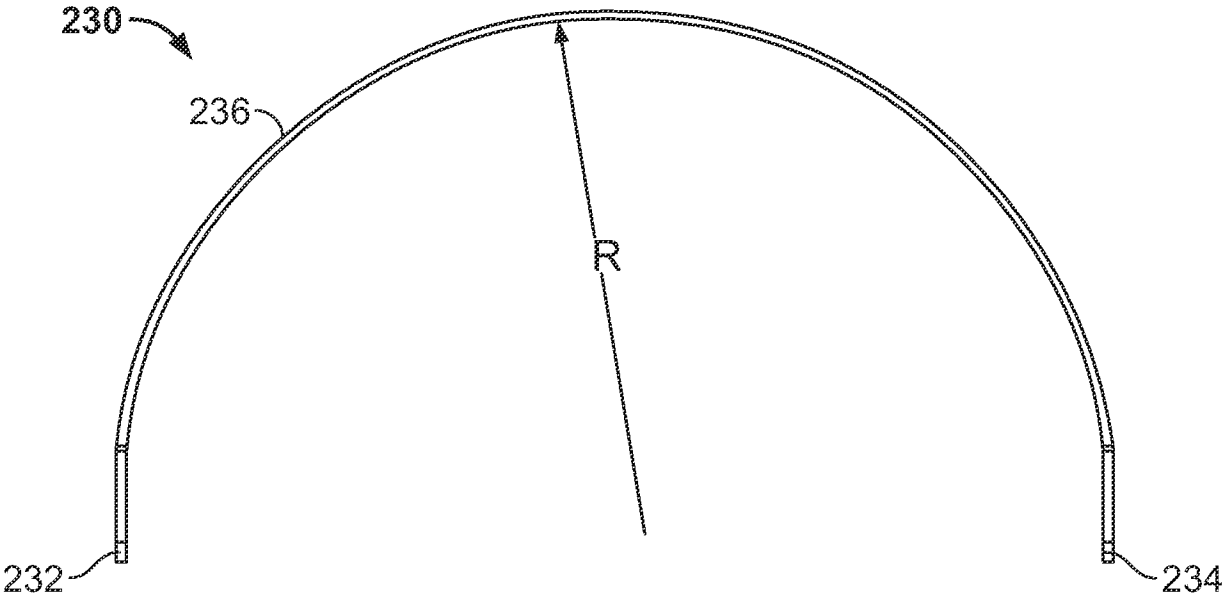
FIG. 10 depicts a top view of an exemplary curved member of the insulating container of FIG. 1, according to one or more aspects described herein.
Figure 11:
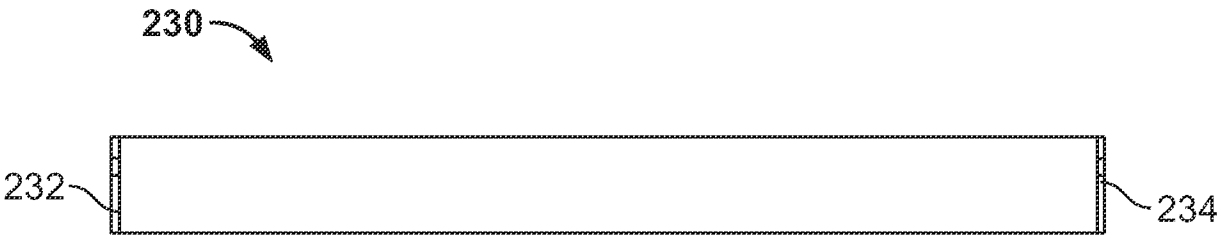
FIG. 11 depicts a front view of an end of the exemplary curved member of FIG. 10, according to one or more aspects described herein.

FIGS. 10-13 depict an exemplary curved member 230, which may also represent curved member 240 as the two curved members may be identical in shape and size. FIG. 10 illustrates a top view of curved member 230 where the curved members 230, 240 have curves that move away from each other, such that the curved members 230, 240 may have a convex outward facing surface. Alternatively or optionally, the curved members 230, 240 may both curve toward each other such that the curved members have the concave side facing outward. As another option, the curved members 230, 240 may have both have curvature that is arranged in the same direction (e.g. the concave sides of both curved members 230, 240 face toward the front of the container 100 or the concave sides of both curved members 230, 240 face toward the rear of the container 100. The curved member 230 may have a curvature defined by an interior radius, R, that may be approximately 145 mm, or within a range of 120 mm and 180 mm in one example and may be approximately 230 mm or within a range of 200 mm and 280 mm in another example. The curvature may be described as a function of the length, L, of the opening 110, the strength of the magnets (i.e., the strength of magnet strips 210, 220), the horizontal distance between ends 232, 234, and the desired stiffness of the curved members 230, 240. In some examples, the curvature of the curved members 230, 240 may be expressed as a percentage of a length, L, of the opening 110 when length, L, is measured when the opening 110 is in the closed configuration. For example, the curvature of the curved member 230 may be approximately 30 percent of the length, L, or approximately 38 percent of the length, L, or within a range of 25 percent and 45 percent of the length, L, of the opening 110, or within a range of 15 percent of the length, L, and 60 percent of the length, L.

Figure 12:
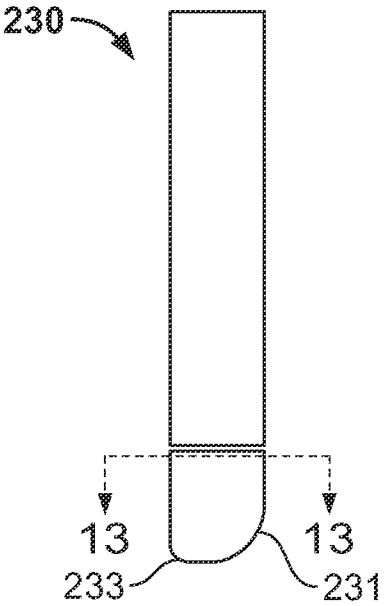
FIG. 12 depicts a side view of an end of the exemplary curved member of FIG. 9, according to one or more aspects described herein.

As described above, the first curved member 230 may have a first end 232, a second end 234, and a curved member body 236 that extends between the first end 232 and the second end 234. Similarly, the second curved member 240 may have a first end 242, a second end 244, and a curved member body 246 that extends between the first end 242 and the second end 244. Each end 232, 234, 242, 244 of the curved members 230, 240 may have a curved profile as shown in FIG. 12. As shown, each end 232, 234, 242, 244 may have a lower portion 231 with a larger radius than an upper portion 233. In some examples, the radius for the lower portion 231 may be up to three times larger than the radius of the upper portion 233. Alternatively, each end 232, 234, 242, 244 may have a lower portion with a radius that is equal with the upper portion. By having a rounded profile on each end 232, 234, 242, 244, the curved members 230, 240 may avoid damaging any of the portions of the container 100 as the ends 232, 234, 242, 244 move during the opening and closing process (i.e., the outer shell 102, the inner liner 122, the insulating layer 124, or the receivers 250, 260).

The curved members 230, 240 may be formed of various materials and dimensions to create the desired spring forces for the closure mechanism 200. For instance, in one example, the curved members 230, 240 may include a core portion formed from a steel alloy with a thickness of approximately 3 mm, or within a range of 1.5 mm and 5 mm and a width of approximately 25 mm, or within a range of 15 and 40 mm. In other examples, the curved members 230, 240 may be formed from other metallic materials, such as aluminum based alloys, titanium alloys, or other metallic materials. The curved members 230, 240 may be formed using an extrusion process and may have a substantially constant cross-sectional shape. The curved member 230, 240 may have a substantially rectangular cross-sectional shape although alternate cross-sectional shapes are contemplated such as square, oval, round, elliptical, triangular, or other geometric shapes. In some examples, the curved members 230, 240 may have a concave or convex shaped cross-sectional shape.

Figure 13:
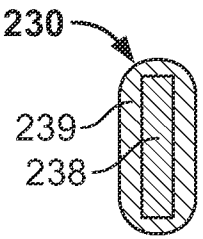
FIG. 13 schematically depicts a cross-sectional view of the exemplary curved member of FIG. 10, according to one or more aspects described herein.

When using a metallic material for the core portion 238, the curved member 230, 240 may include a non-metallic outer layer 239 as shown in FIG. 13. The non-metallic outer layer 239 may be an elastomeric material, a polyethylene based material, or a polyvinyl chloride based material. This encapsulation helps to protect the core portion 238 from corrosion and also helps to protect the container components from any damage caused by the movement of the curved members 230, 240. The non-metallic coating 239 may also help to reduce friction of the curved members 230, 240 to allow free movement of the ends 232, 234, 242, 244. The metallic core portion 238 may have a constant thickness. The encapsulation may be applied as a heat shrink tube onto the metallic core portion 238, may be injection molded, overmolded, dipped, or powder coated onto the core portion 238, or may be encapsulated by other means known to one skilled in the art. The non-metallic outer layer 239 may be applied to the entire curved members 230, 240 or applied only to the ends 232, 234, 242, 244. For instance, the non-metallic outer layer 239 may be applied from the ends 232, 234, 242, 244 to a distance of approximately 30 to 80 mm from ends 232, 234, 242, 244. In some examples, the non-metallic outer layer 239 may only be applied to one of the ends 232, 234, 242, 244 of each curved member 230, 240. In some examples, the curved members 230, 240 may be coated with the non-metallic coating 239 with the exception of a portion of one end which is used to grip the curved member 230, 240 when the coating is applied that leaves that end with an exposed portion. In these case, the exposed portion may be coated using a heat shrink tubing to encapsulate the exposed portion.

In alternate examples, the curved members 230, 240 may be formed from a non-metallic material such as a high strength polymer, such as polycarbonate, a fiberglass material, or a composite material. A non-metallic curved member may have similar end geometry as described above and may or may not be encapsulated in an elastomeric material. As another option, the thickness may be variable as to adjust the stiffness and durability of the curved member.

Figure 14A:
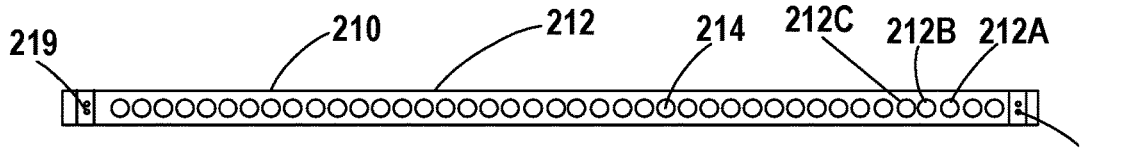
FIG. 14A-14D depict front and side views of magnetic strips, which may be used to form a magnetic closure of an opening of the insulating device of FIG. 1, according to one or more aspects described herein.
Figure 14B:
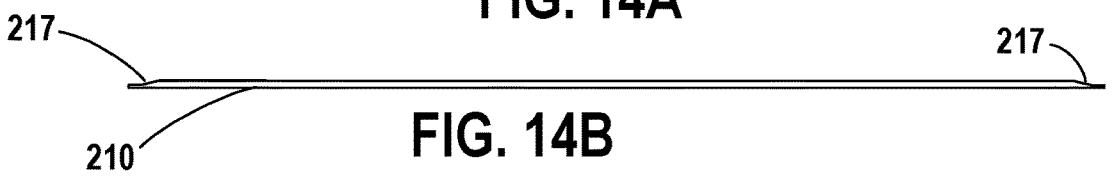
Figure 14C:
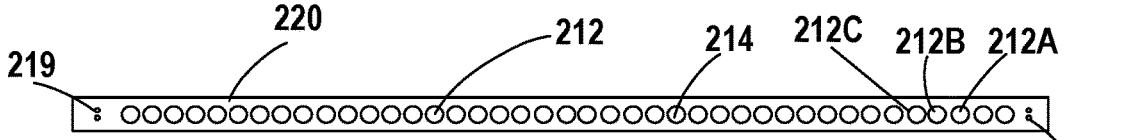
Figure 14D:
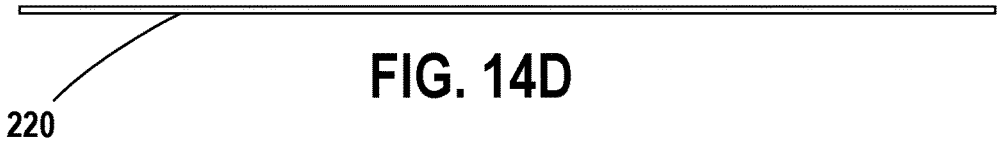

FIGS. 14A-B depict a front and side view of the front magnetic strip 210, while FIGS. 14C-D depict a front and side view of the rear magnetic strip 220. The two magnetic strips 210 and 220 may be used to form the closure mechanism 200 of the opening 110. As previously described, the closure mechanism 200 may be used to resealably seal the opening 110. The magnetic strips 210, 220 may have a magnetic strength of approximately 4500 Gauss, or within a range of 3500 Gauss and 5500 Gauss, wherein the magnetic strength is checked with the opening 110 is in a closed configuration and a magnetic tester is placed directly between the two magnetic strips 210, 220. In one implementation, both of the magnetic strips 210 and 220 include a series of discrete permanent magnets that are retained within magnet wells 212. In one example, the first magnetic strip 210 and the second magnetic strip 220 may comprise a row of circular magnetic elements 214 spaced apart of a flexible polymer strip that are rigidly affixed into the magnet wells 212. While the magnetic elements 214 are depicted as circular magnetic elements, it is contemplated that the magnetic elements may be of any shape, such as rectangular, square, triangular, oval, or other geometric shape as known to one skilled in the art. As shown in the illustrated examples, magnetic strip 210 may include a tapered region 217 at either or both ends as shown in FIG. 14B. This tapered region 217 assists in the proper fit of the magnetic strip 210 and to ensure a proper seal. The tapered region 217 may be formed on both of the magnetic strips 210, 220 or may only be on one of the magnetic strips. As shown in FIG. 14D, magnetic strip 220 may not have the tapered region 217 and have a constant thickness. Optionally, both magnetic strips 210, 220 may not have a tapered region and have a constant thickness. The magnetic elements 214 may be oriented such that adjacent magnetic elements 214 have opposite polarity. For example, for the magnets 214 positioned within the exemplary wells 212, the magnet 214 within well 212A may face its north pole toward magnetic strip 210, the magnet 214 within well 212B may face its south pole toward magnetic strip 210, and the magnet 214 within well 212C may face its north pole toward magnetic strip 210, etc. It is contemplated that the magnetic strips 210 and 220 may be coupled to the front portion 130 and back portion 160 using any fixation methodology, technique and/or technology. In some examples, the ends of each magnetic strip 210, 220 may be welded to the container 100. To prevent distortion of the magnetic strips 210, 220 during the welding process, each magnetic strip 210, 220 may include one or more relief holes 219 near the end of each magnetic strip 210, 220 as shown in FIGS. 14A and 14C. The relief holes 219 may be outboard of the magnetic wells 212 and may help to prevent any distortion of the magnetic strips 210, 220 during the welding process by providing a location to receive any flowable material generated by the welding process. The relief holes 219 may be blind holes with a predetermined depth, but may also extend through the magnetic strip 210, 220. The relief holes 219 may also be located on the tapered region 217 of one of the magnetic strips 210, 220 and have a diameter that is smaller than the diameter of the wells 212. While the illustrated examples show two relief holes 219 near each end of the magnetic strips 210, 220, the number of relief holes 219 may be a single hole, 3 holes, or more than 3 holes near each end. It is further contemplated that the magnets 214 affixed within the wells 212 may be constructed from any material, without departing from the scope of these disclosures. As depicted, a pull tab 116, which may be configured to be manually gripped to pry apart the magnetic strips 210, 220 of the closure mechanism 200 of the opening 110, may extend from one of the magnetic strips 210 or 220. In an alternative implementation, each of the magnetic strips 210 and 220 may include a pull tab 116. In yet another implementation, the pull tab 116 may not be coupled to one of the magnetic strips 210 or 220. In such an implementation, the pull tab 116 may instead be coupled to one or both sides of the opening 110. For example, one or more pull tabs 116 may be coupled to one or both of the front side 112 and the back side 114 of the opening 110, and may not form part of the magnetic strip 210 or the magnetic strip 220. In yet another example, the insulating container 100 may be implemented without one or more pull tabs 116 on the front portion 130 and/or the back portion 160. The first and second magnetic strips 210 and 220 may have top edges that are coupled to the respective front and back sides 112 and 114 of the opening 110. The first and second magnetic strips 210, 220 may have bottom edges that are not attached to an internal surface of the container 100, and may be described as loose ends.

Figure 15:
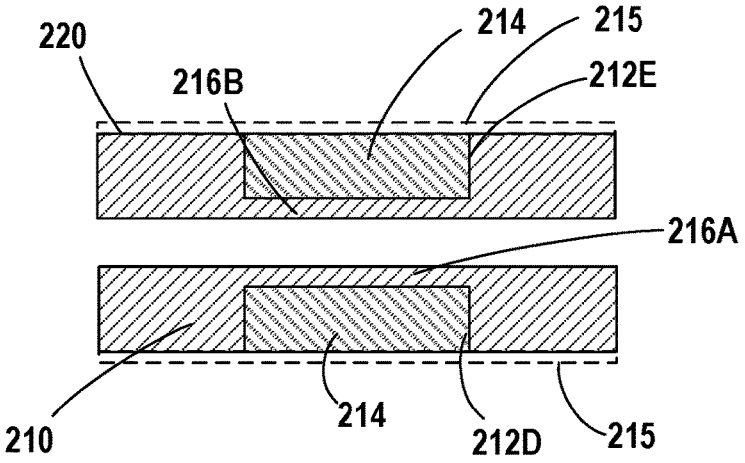
FIG. 15 schematically depicts a cross-sectional view of the magnetic strips of FIG. 14, according to one or more aspects described herein.

FIG. 15 schematically depicts a cross-sectional view of the magnetic strips 210 and 220. In one example, the magnetic strips 210 and 220 may be constructed from a thermoplastic polyurethane (TPU). However, it is contemplated that combination of polymers, metals, or alloys, among others, may be used to construct the magnetic strips 210 and 220. FIG. 15 depicts two exemplary magnet wells 212D and 212E, which are opposite one another and configured to retain to magnets 214. In one example, buffer layers 216A and 216B separate the magnets 214 positioned within wells 212D and 212E, when magnetically coupled to one another. It is contemplated that these buffer layers 216A and 216B may be implemented with a predetermined thickness such the magnetic attraction is maintained. In addition, a sealing film 215 may be placed on the front or rear surfaces (e.g. over the side that receives the magnets 214). This sealing film 215 may help to prevent moisture intrusion into the magnetic strips 210, 220 and may be a clear or opaque material. In some examples, the sealing film 215 may be made from a TPU materials, but may be made of any suitable material known to one skilled in the art.

In another implementation, the magnetic strips 210 and 220 may be implemented without the buffer layers 216A and 216B, such that the magnets 214 held within wells 212D and 212E are positioned proximate one another when magnetically coupled to one another. In yet another example, the buffer layers 216A and 216B may be formed from an alternative material type to the rest of the structure of the magnetic strips 210, 220, without departing from the scope of these disclosures.

The primary seal of the insulating container 100 created by the magnetic closure of the opening 110 and the secondary seal created by the folding of the flap portion 140 may combine to make the insulating container 100 substantially water and/or airtight. In certain specific examples, the insulating container 100 may be configured to retain water (ice and melted ice) without or with reduced leakage of water from the storage compartment 120 through the opening 110 and out to the external environment. In certain specific examples, the insulating container 100 may be configured to be positioned on its side (e.g., front portion 130 or back portion 160) and/or positioned in a downward facing orientation (with opening 110 facing downward) and the container 100 may be configured to prevent or substantially reduce the egress of water held within the storage compartment 120 when held in one of these positions for prolonged periods of time. In certain specific examples, the insulating container 100 may be configured allow less than 5%, 2%, 1%, 0.5%, 0.1%, 0.05%, or 0.01% of the water (or water and ice combination) held within the storage compartment 120 to leak out though the opening 110 when the insulating container 100 is held for at least 1 minute, 2 minutes, 5, minutes, 10 minutes, 15 minutes, 20 minutes, 25 minutes, 30 minutes, 35 minutes, 45 minutes, or 1 hour with the opening 110 facing downward at an incline of: 90 degrees (i.e., upside down), 60 degrees, 45 degrees, 30 degrees, or 0 degrees (i.e., the container held on front portion 130 or back portion 160).

Figure 16:
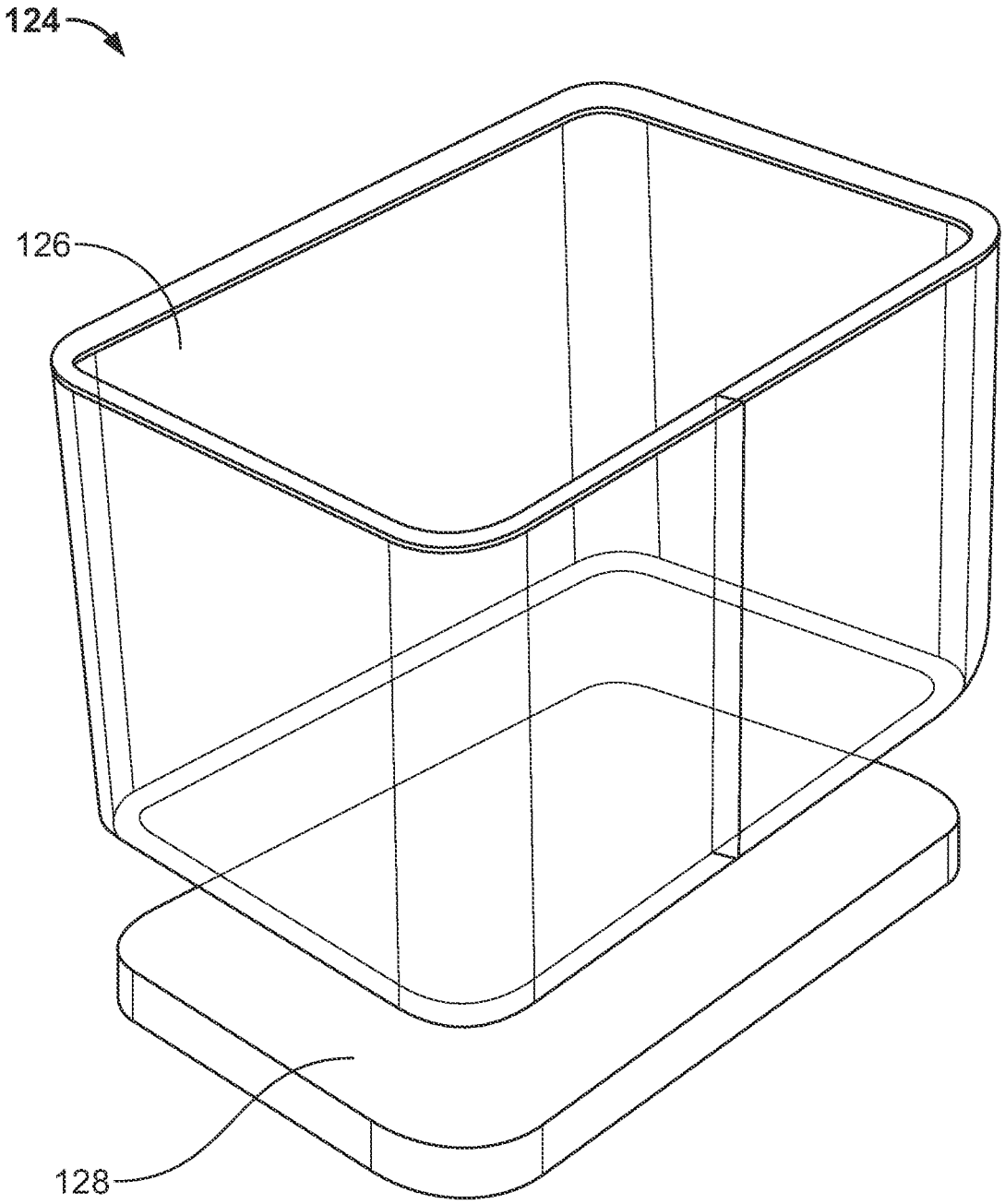
FIG. 16 schematically depicts an insulating layer of the insulating container of FIG. 1, according to one or more aspects described herein.
Figure 17:
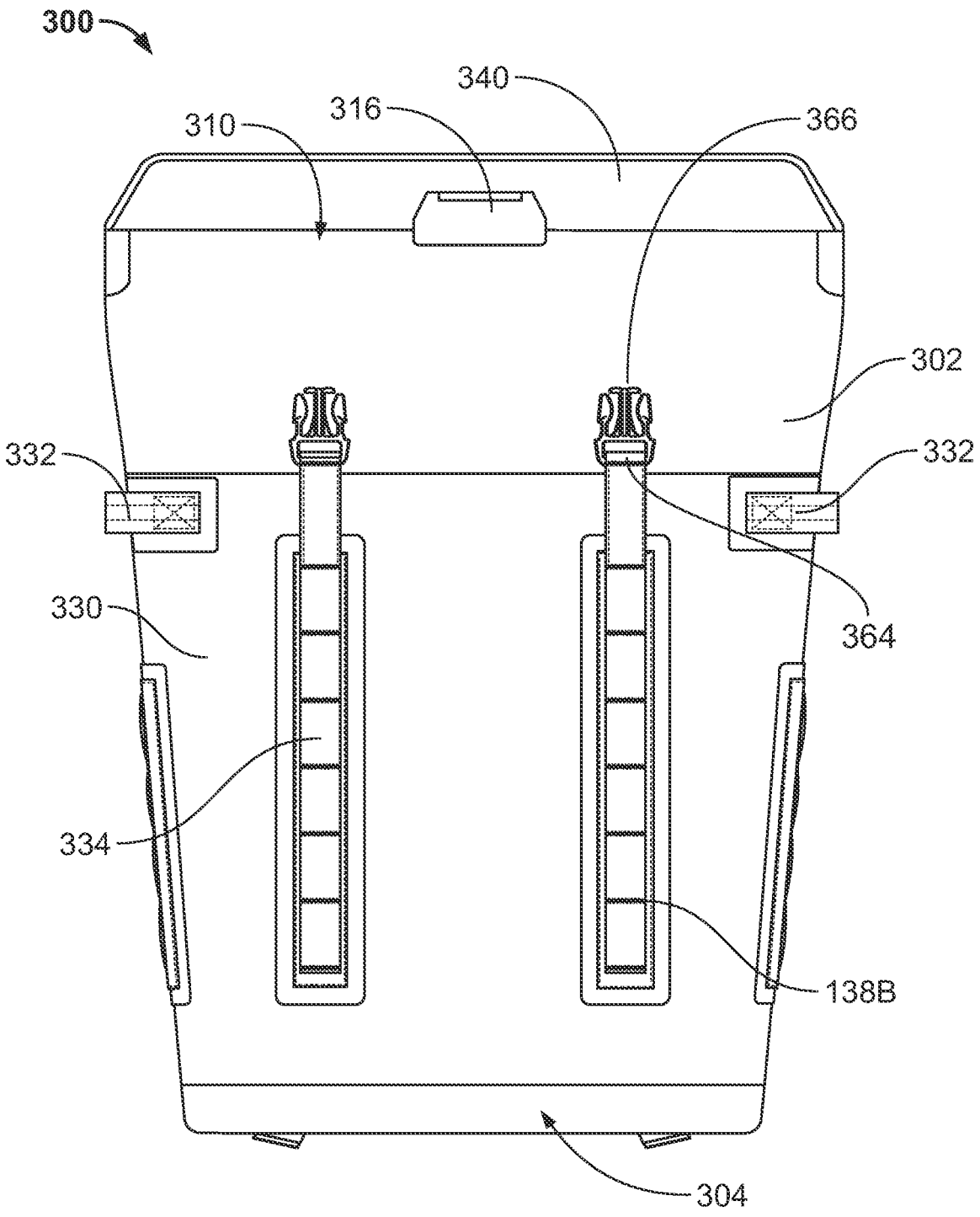
FIG. 17 depicts a front view an another exemplary insulating container that can be configured to keep contents cool or warm for an extended period of time, according to one or more aspects described herein.
Figure 18:
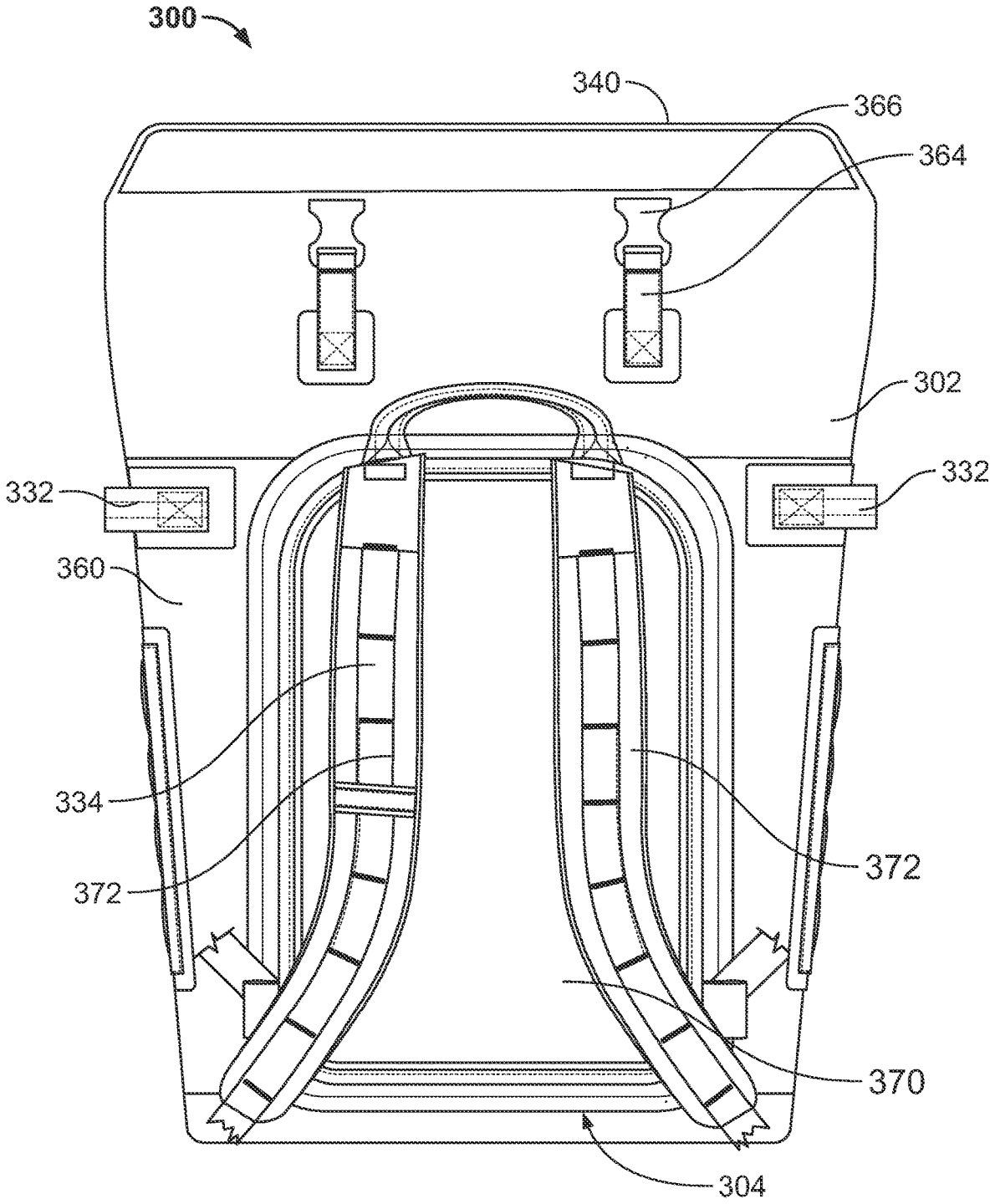
FIG. 18 depicts a back view of the exemplary insulating container of FIG. 17, according to one or more aspects described herein.
Figure 20:
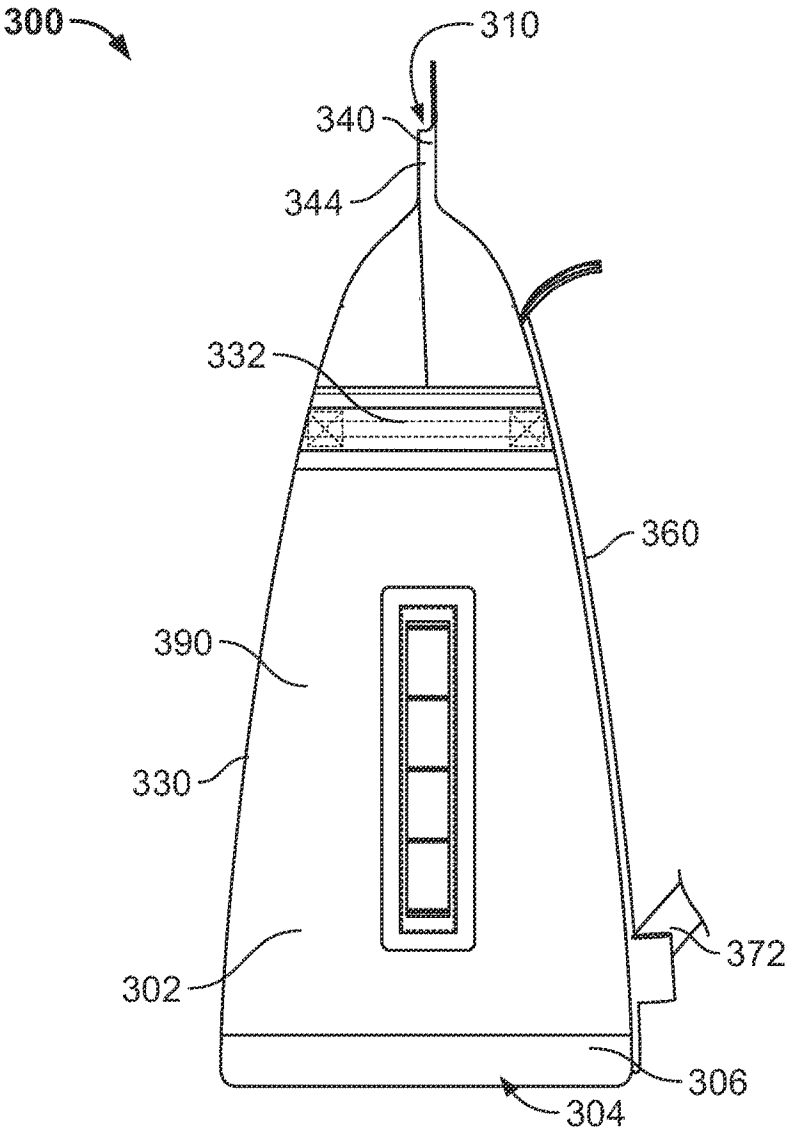
FIG. 20 depicts a right side view of the exemplary insulating container of FIG. 17, according to one or more aspects described herein.
Figure 19:
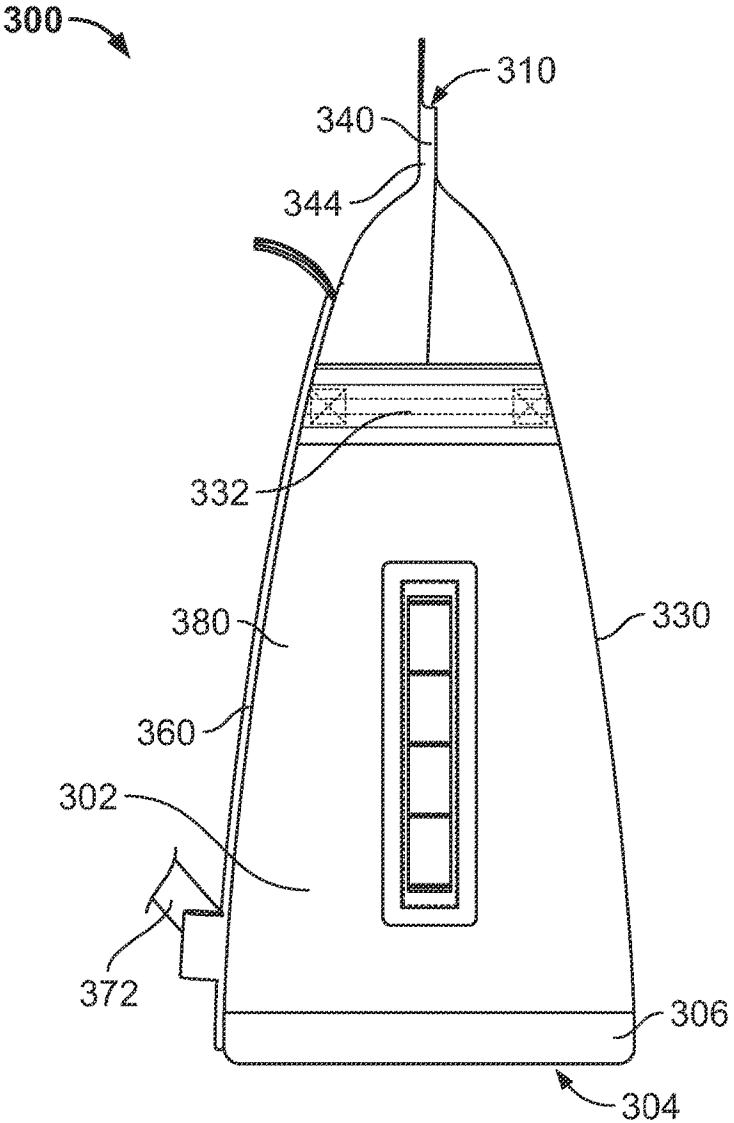
FIG. 19 depicts a left side view of the exemplary insulating container of FIG. 17, according to one or more aspects described herein.

FIG. 16 schematically depicts the insulating layer 124 for the insulating container 100. The insulating layer 124 may be formed of a first portion or an upper portion 126, a second portion or base portion 128. It is contemplated that the insulating layer 124 may be formed from any insulating material. The insulating material of the insulating layer 124 may include, among others, an EVA foam that may include a nonwoven scrim layer laminated on both sides of the upper portion 126 to help quiet any noise made from movement of the insulating layer within the container 100, while the lower portion 128 may not have the scrim layer and/or any other foam material having any density and/or insulation values/properties. The nonwoven scrim layer may be removed at the bottom edge of the upper portion 126 to assist in bonding the upper portion 126 of the insulating layer 124 to the base portion 128.

FIGS. 17-22 depict an alternate insulating container 300 that may be configured with closing mechanism 200. For the exemplary container of FIGS. 17-22, the features are referred to using similar reference numerals under the "3xx" series of reference numerals, rather than "1xx" as used in the example of FIGS. 1-16. Accordingly, certain features of the container 300 that were already described above with respect to insulating container 100 of FIGS. 1-16 may be described in lesser detail, or may not be described at all. Additionally, any features described above with respect to the insulating container 100 in FIGS. 1-16 may be utilized with insulating container 300. Additionally or alternatively, the insulating containers 100, 300 may be configured in different sizes (i.e., height, width, and depth) without departing from the scope of the disclosure described herein.

Container 300 may be configured as an insulating container that may be carried as a backpack. Insulating container 300 may generally include an outer shell 302 that defines a front portion 330, a back portion 360, a left side portion 380, a right side portion 390, and a base 304. In one example, the front portion 330, the back portion 360, and the side portions 380, 390 may collectively be referred to as the sidewall of the container 300. The container 300 additionally includes an opening 310 at a top portion of a flap portion 340. Accordingly, the flap portion 340 is configured to extend between a top of the outer shell 302, and the opening 310. The opening 310 is configured to provide a resealable point of entry into a storage compartment 320 of the container 300. The back portion 360 of container 300 may include a back pad 370 and a pair of elongated and adjustable straps 372 to allow a user to carry the insulating container 300 like a backpack. While container 300 is configured as a backpack, the closure mechanism described herein may also be utilized in other soft sided containers, such as a duffel bag, soft sided suitcase, or other soft sided container known to one skilled in the art.

Container 300 may have an opening 310 that is resealably sealed by closure mechanism 200 similar to the container 100, where the container 300 may have an open configuration that allows access to the storage compartment and a closed configuration that prevents access to the storage compartment. The closure mechanism 200 for container 300 may include a first magnetic strip 210, a second magnetic strip 220, a first curved member 230, and a second curved member 240 and work in a similar manner as closure mechanism 200 described above and illustrated in FIGS. 5, 6A, and 6B as one manner in which the closure 200 may be arranged.

Figure 21:
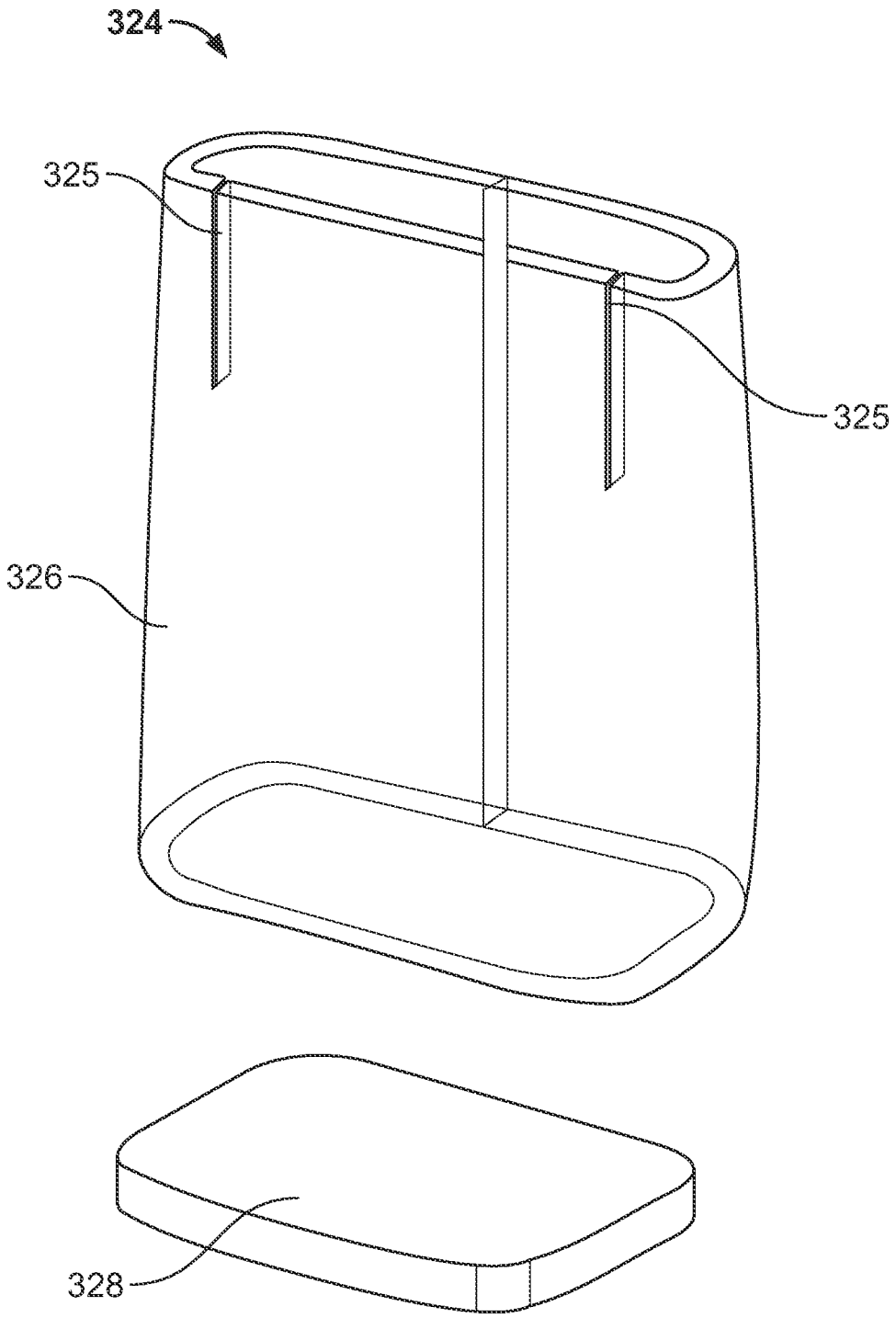
FIG. 21 schematically depicts an insulating layer of the insulating container of FIG. 17, according to one or more aspects described herein.

Container 300 may have a smaller size than container 100, to make it easier to carry for a user. As such, as shown in FIG. 21 schematically depicts the insulating layer 324 for the insulating container 300. The insulating layer 324 may be formed of a first portion or an upper portion 326, a second portion or base portion 328. The upper portion 326 may include slits 325 in the upper portion 326 to allow for more flexibility within the insulating layer 324. The slits 325 may be arranged along the front of the insulating layer 324 as shown, or may be in other locations such as on the left and right side along the upper portion 326, or in other locations as contemplated by one skilled in the art to provide adequate insulation while also being flexible to move with the container 300. It is contemplated that the insulating layer 324 may be formed from any insulating material. The insulating material of the insulating layer 324 may include, among others, an EVA foam that may include a nonwoven scrim layer laminated on both sides of the upper portion 326 to help quiet any noise made from movement of the insulating layer within the container 300, while the lower portion 328 may not have the scrim layer and/or any other foam material having any density and/or insulation values/properties. The nonwoven scrim layer may be removed at the bottom edge of the upper portion 326 to assist in bonding the upper portion 126 of the insulating layer 124 to the base portion 328.

Figure 22:
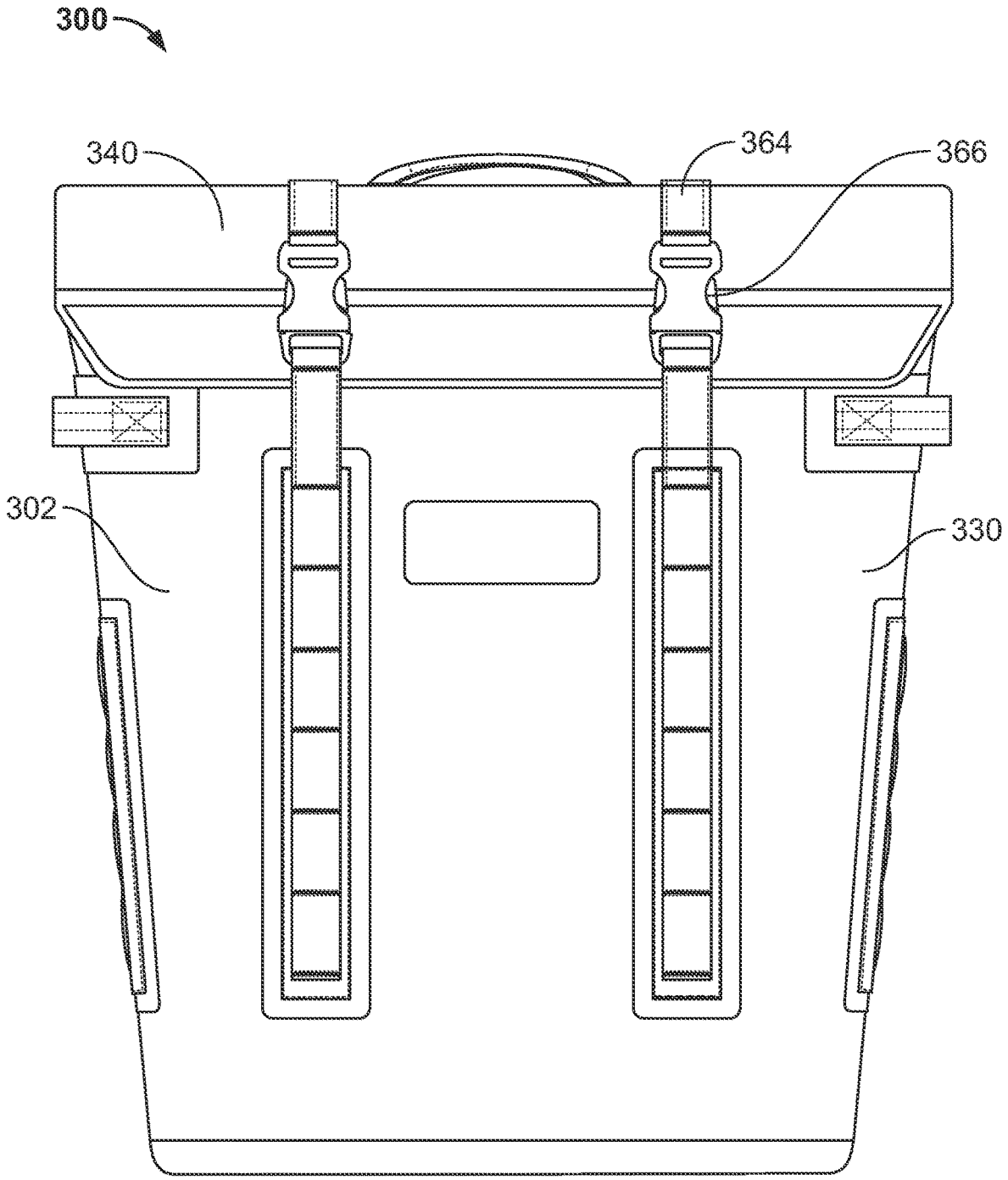
FIG. 22 depicts a front view of the exemplary insulating container of FIG. 17 in a closed and folded configuration, according to one or more aspects described herein.

FIG. 22 illustrates container 300 in with the flap portion 340 folded and held in a folded configuration by buckles 366 and straps 364 that extend over the top of the container 300 between the back portion 360 and the front portion 330. Strap 364 and buckle 366, which may be releasably coupled to a corresponding strap 334 and buckle 366 on the front portion 330. The coupled straps 364 may be utilized to hold the flap portion 340 in a folded configuration.

Figure 23:
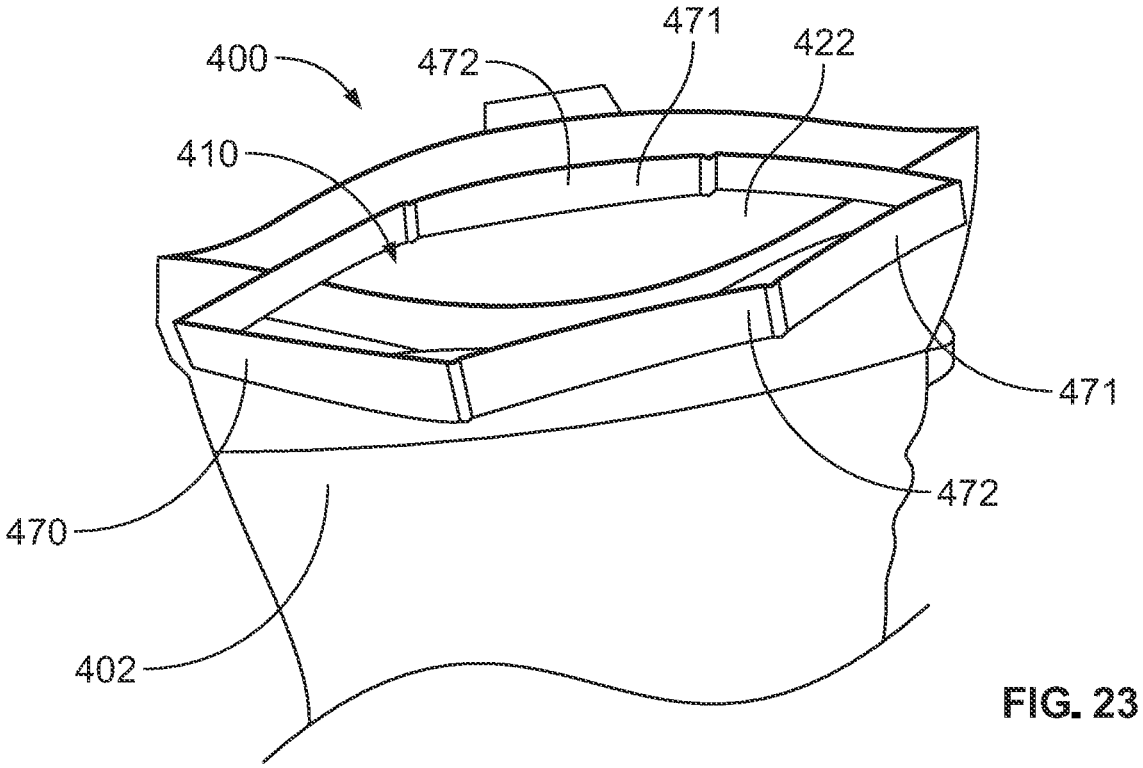
FIG. 23 depicts a schematic perspective view of an alternate insulating container of FIG. 1, according to one or more aspects described herein.
Figure 24:
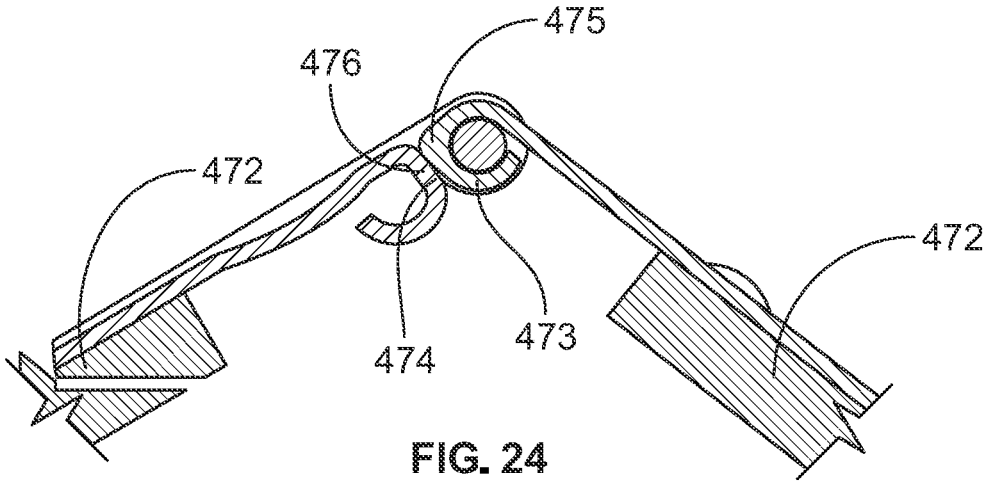
FIG. 24 depicts a schematic side view of an exemplary hinge in an unlocked position of the insulating container of FIG. 23, according to one or more aspects described herein.
Figure 25:
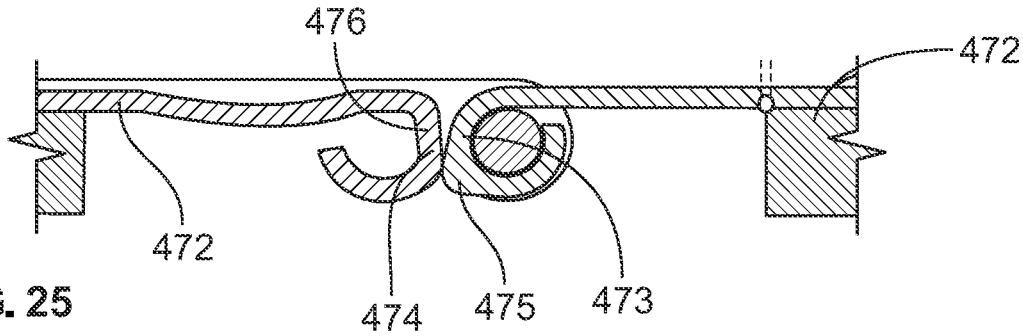
FIG. 25 depicts a schematic side view of the exemplary hinge of FIG. 24 in a locked position, according to one or more aspects described herein.

FIGS. 23-25 illustrate an alternate insulating container 400. For the exemplary container of FIGS. 23-25, the features are referred to using similar reference numerals under the "4xx" series of reference numerals, rather than "1xx" as used in the example of FIGS. 1-16. Accordingly, certain features of the container 400 that were already described above with respect to insulating container 100 of FIGS. 1-16 may be described in lesser detail, or may not be described at all. Additionally, any features described above with respect to the insulating container 100 in FIGS. 1-16 may be utilized with insulating container 400. Additionally or alternatively, the insulating container 400 may be configured in different sizes (i.e., height, width, and depth) without departing from the scope of the disclosure described herein. Insulating container 400 may have a closure mechanism 200 similar to closure mechanism 200 described above except the curved members 230, 240 may be replaced by a hinged expander 470. Accordingly, the closure mechanism 200 of container 400 may include a first magnetic strip 210, a second magnetic strip 220, and a hinged expander 470 that can help to keep the opening 410 of the container 400. The hinged expander 470 may be arranged along an interior surface of the container or between the outer shell 402 and inner liner 422 of the container 400. The hinged expander 470 may have a first and second member 471 where each member 471 is located on each side of the opening 410. Each member 471 may be joined together at each end with a pinned connection. Each member 471 may be formed from a plurality of hinged elements 472, where each hinged element 472 may have a first end 473 that has a cam 475 or bulged region that engages an engaging member 476 on a second end 474 of the adjacent hinged element 472. The hinged elements 472 may be pinned together where the cam 475 locks the first end 473 of the adjacent hinged element 472 with a second end 474. As shown in FIG. 24, the hinged elements 472 may be in a locked position to help keep the opening 410 of the container 400 in an opened position as the hinged elements 472. As the cam 475 moves past a predetermined location on the engaging member 476, the cam 475 may lock into place to keep the hinged elements 472 in an intersecting or converging orientation. When the hinged elements 472 are locked into the converging orientation, the hinged expander 470 may be arranged to overcome the magnetic forces between the magnetic strips 210, 220 to keep the opening 410 in an open position. When a user closes the opening, the user will apply a force to move the cam 475 over the predetermined location on the engaging member 476 to cause the adjacent hinged elements 472 to form an approximately coplanar or collinear orientation as shown in FIG. 25. When the hinged elements 472 are in the coplanar or collinear orientation, the first and second members 471 of the hinged expander 470 forms two substantially parallel members 471 that allow the magnetic strips 210, 220 to close the opening 410.

Figure 26:
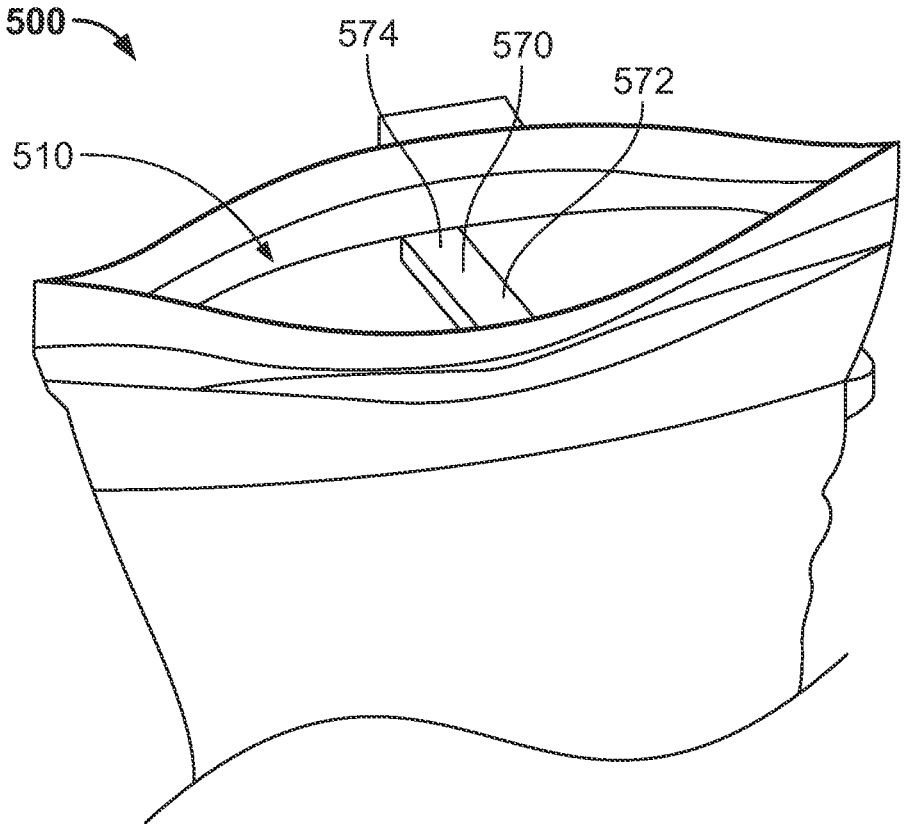
FIG. 26 depicts a schematic perspective view of an alternate insulating container of FIG. 1, according to one or more aspects described herein.
Figure 27:
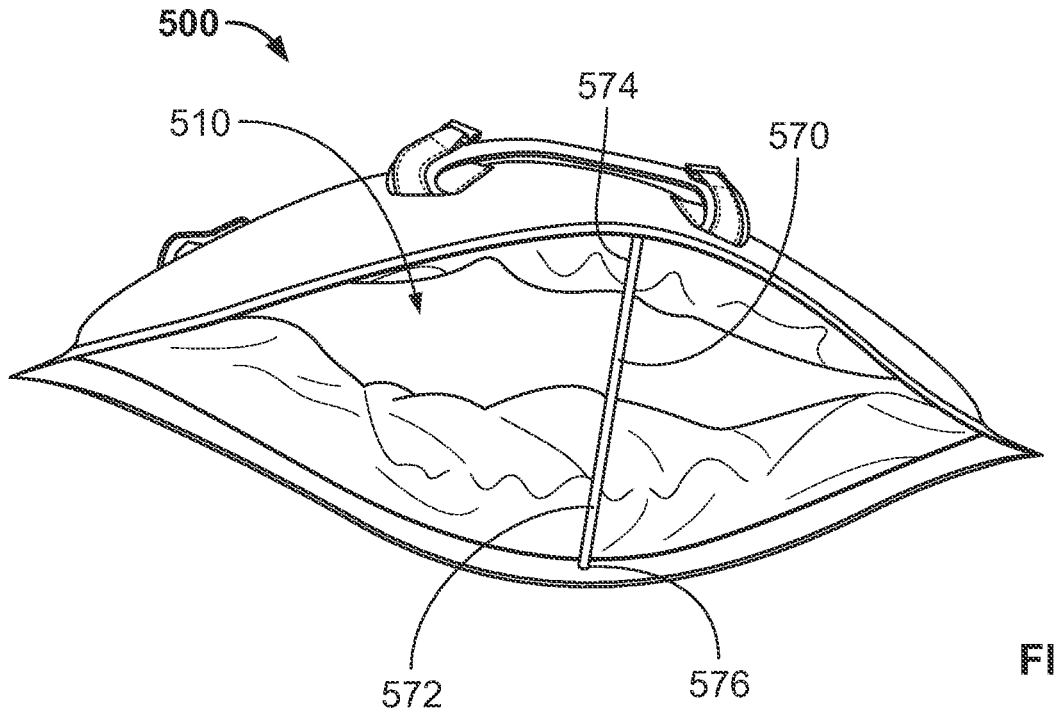
FIG. 27 depicts a top perspective view of the insulating container of FIG. 26, according to one or more aspects described herein.

FIGS. 26 and 27 illustrate an alternate insulating container 500. For the exemplary container of FIGS. 26-27, the features are referred to using similar reference numerals under the "5xx" series of reference numerals, rather than "1xx" as used in the example of FIGS. 1-16. Accordingly, certain features of the container 500 that were already described above with respect to insulating container 100 of FIGS. 1-16 may be described in lesser detail, or may not be described at all. Additionally, any features described above with respect to the insulating container 100 in FIGS. 1-16 may be utilized with insulating container 500. Additionally or alternatively, the insulating container 500 may be configured in different sizes (i.e., height, width, and depth) without departing from the scope of the disclosure described herein. Insulating container 500 may have a closure mechanism 200 similar to closure mechanism 200 described above except the curved members 230, 240 may be replaced by a kickstand 570. Accordingly, the closure mechanism 200 of container 500 may include a first magnetic strip 210, a second magnetic strip 220, and a kickstand 570 that can help to keep the opening 510 of the container 500. The kickstand 570 may comprise a beam or rod 572 with a first end 574 and a second end 576 opposite the first end 574. Each end 574, 576 may be received into a receiver located in each side of the opening 510 to secure the rod 572 within the opening 510 to maintain the opening 510 in an open position and overcome the magnetic forces from the magnetic strips 210, 220. In some examples, the rod 572 may be a free member that is stored in a compartment of the container 500. In other examples, the rod 572 may be attached at a first end 574 or a second end 576 while the opposite end is free. The rod 572 may rotate around the attached end while when a user wants to put the kickstand 570 into a usage position, the rod 572 may be rotated such that the free end is secured in a receiver on the opposite side of the opening 510 from where the rod 572 is attached. When the kickstand 570 is engaged position to keep the opening 510 in the open configuration, a user may easily load the container 500. When the kickstand 570 is unengaged, the magnetic forces from the magnetic strips 210, 220 are able to secure the opening 510 in the closed configuration.

Figure 28:
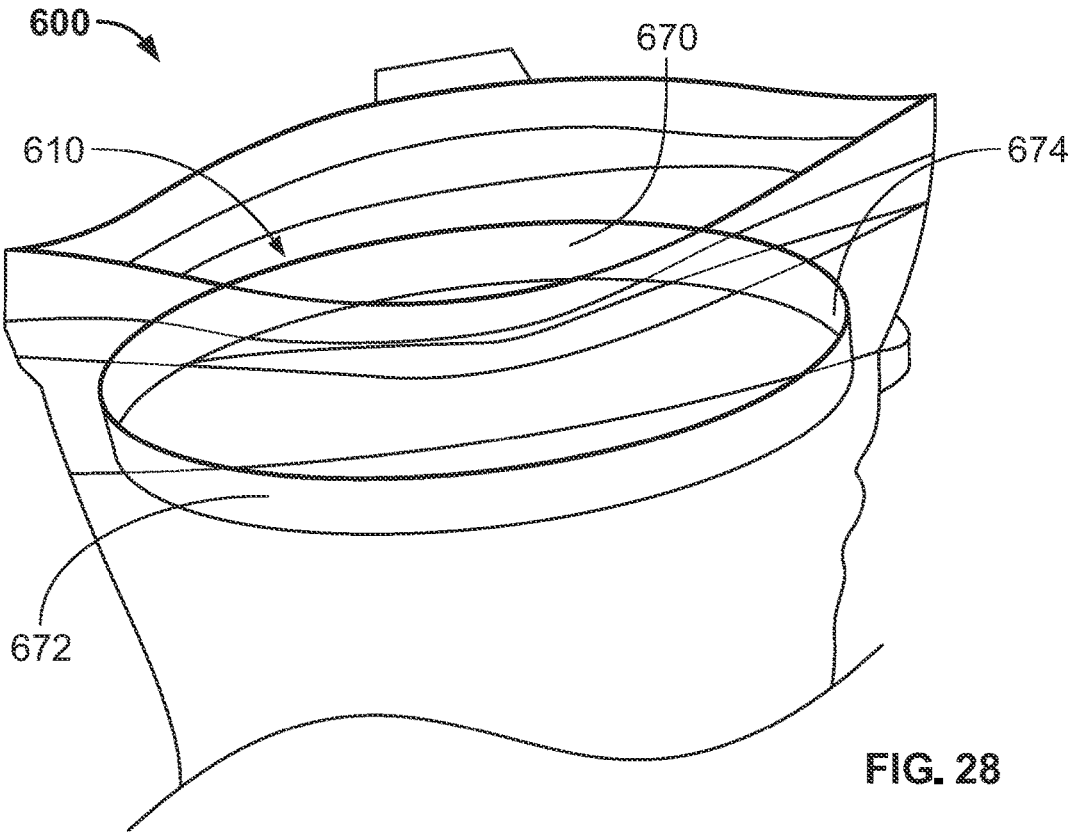
FIG. 28 depicts a schematic perspective view of an alternate insulating container of FIG. 1, according to one or more aspects described herein.

FIG. 28 illustrates another insulated container 600. For the exemplary container of FIG. 28, the features are referred to using similar reference numerals under the "6xx" series of reference numerals, rather than "1xx" as used in the example of FIGS. 1-16. Accordingly, certain features of the container 600 that were already described above with respect to insulating container 100 of FIGS. 1-16 may be described in lesser detail, or may not be described at all. Additionally, any features described above with respect to the insulating container 100 in FIGS. 1-16 may be utilized with insulating container 600. Additionally or alternatively, the insulating container 600 may be configured in different sizes (i.e., height, width, and depth) without departing from the scope of the disclosure described herein. Insulating container 600 may have a closure mechanism 200 similar to closure mechanism 200 described above except the curved members 230, 240 may be replaced by a stiffener loop 670 that extends around the opening 610 of the container 600. The stiffener loop 670 may be located along the interior of the container 600. The stiffener loop 670 may be a continuous loop of metallic material with elongated rounded sides 672 and rounded end portions 674. The elongated rounded sides 672 may be arranged to help hold the opening 610 in an open configuration once a user has opened the opening 610. The elongated rounded sides 672 may provide spring forces in a similar manner as the curved members 230, 240 described above. Accordingly, the closure mechanism 200 of container 600 may include a first magnetic strip 210, a second magnetic strip 220, and a stiffener loop 670 that can help to keep the opening 610 of the container 600. The stiffener loop 670 may have a constant thickness and constant height. When the container 600 is in the open configuration, the stiffener loop 670 provides spring forces to counteract the magnetic forces of the magnetic strips 210, 220 and to help keep the container 600 in an open configuration once the user opens the container 600. Similarly, once a user moves to close the container the stiffener loop 670 may help to provide the closure mechanism 200 to move from an open configuration to a closed configuration in a slow and controlled manner. Once the closure mechanism 200 is in a closed configuration, the magnetic forces overcome the spring forces created by the stiffener loop 670 and may deform the stiffener loop 670 such that the elongated rounded sides 672 may be flattened such that the elongated rounded sides 672 may be substantially parallel. In some examples, the stiffener loop 670 may be formed from a non-metallic material.

Figure 29:
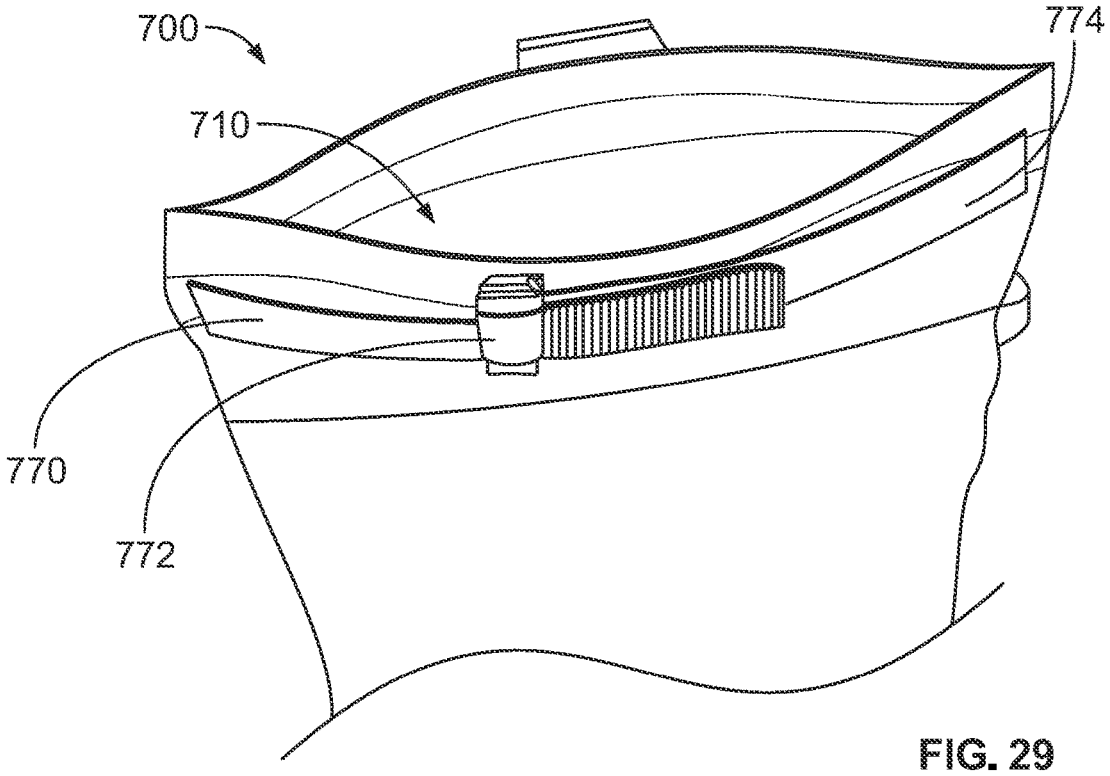
FIG. 29 depicts a schematic perspective view of an alternate insulating container of FIG. 1, according to one or more aspects described herein.

FIG. 29 illustrates another insulated container 700. For the exemplary container of FIG. 29, the features are referred to using similar reference numerals under the "7xx" series of reference numerals, rather than "1xx" as used in the example of FIGS. 1-16. Accordingly, certain features of the container 700 that were already described above with respect to insulating container 100 of FIGS. 1-16 may be described in lesser detail, or may not be described at all. Additionally, any features described above with respect to the insulating container 100 in FIGS. 1-16 may be utilized with insulating container 700. Additionally or alternatively, the insulating container 700 may be configured in different sizes (i.e., height, width, and depth) without departing from the scope of the disclosure described herein. Insulating container 700 may have a closure mechanism 200 similar to closure mechanism 200 described above except the curved members 230, 240 may be replaced by a ratcheting strap 770 that extends around the opening 710 of the container 700. The ratcheting strap 770 may include a ratcheting mechanism 772 that may be activated by a user to either tighten or loosen the tension with the ratcheting strap 770. As the tension is increased within the strap 770, the opening 710 may be squeezed open by deforming the magnetic strips 210, 220 to overcome the magnetic forces between them and to keep the opening 710 in an open configuration. Conversely, as the ratcheting mechanism 772 is engaged by a user to release the tension in the strap 774, the magnetic forces between the magnetic strips 210, 220 may overcome the tension in the strap 774 to cause the closure mechanism 200 to move to a closed configuration.

The present disclosure is disclosed above and in the accompanying drawings with reference to a variety of examples. The purpose served by the disclosure, however, is to provide examples of the various features and concepts related to the disclosure, not to limit the scope of the disclosure. One skilled in the relevant art will recognize that numerous variations and modifications may be made to the examples described above without departing from the scope of the present disclosure.

We claim:

1. A container, comprising:

an outer shell, and having a front portion, a back portion, and a base portion;

an inner liner forming a storage compartment, the inner liner having a front portion and a back portion;

an insulating layer positioned between the front portion of the outer shell and the front portion of the inner liner and the insulating layer positioned between the back portion of the outer shell and the back portion of the inner liner, the insulating layer providing insulation for the storage compartment;

an opening at a top of the container extending into the storage compartment, wherein the container has an open configuration that allows access to the storage compartment and a closed configuration that prevents access to the storage compartment; and a closure mechanism, further comprising:

a first magnetic strip extending along and coupled to an internal surface of the front portion of the outer shell at a front side of the opening;

a second magnetic strip extending along and coupled to an internal surface of the back portion of the outer shell at a back side of the opening;

a first curved member, wherein the first curved member has a first end, a second end, and a first curved member body extending between the first end and the second end; and a second curved member, wherein the second curved member has a first end, a second end, and a second curved member body extending between the first end and the second end; and wherein the first magnetic strip is magnetically attracted to the second magnetic strip to resealably seal the opening, and the first curved member and the second curved member prevent the opening from closing when the container is in the open configuration; and wherein the second curved member is between the insulating layer and the outer shell.

2. The container of claim 1, wherein the first curved member and the second curved member are configured to flex from a first curved configuration to a second curved configuration when the opening is sealed.

3. The container of claim 1, wherein the first curved member body comprises a substantially rectangular cross-sectional shape.

4. The container of claim 1, wherein the first curved member has a curvature with a radius between 120 mm and 160 mm.

5. The container of claim 1, wherein the first curved member includes a non-metallic coating.

6. The container of claim 1, wherein the first end and the second end of the first curved member both have rounded corners.

7. The container of claim 1, wherein the first curved member includes a portion formed from a steel alloy.

8. The container of claim 1, wherein the first curved member is received in a first receiver in the front portion, and the second curved member is received in a second receiver in the back portion.

9. The container of claim 8, wherein the first end and the second end of the first curved member are slidable within the first receiver.

10. The container of claim 1, further comprising:

a flap portion extending from the back portion above the back side of the opening, the flap portion having a first fastener element;

a second fastener element coupled to an external surface of the front portion of the outer shell; and wherein the outer shell is configured to fold to removably couple the first fastener element to the second fastener element.

11. The container of claim 1, wherein at least one of the first magnetic strip and the second magnet strip comprises a row of circular magnetic elements spaced apart along a flexible polymer strip.

12. The container of claim 1, further comprising a pair of straps coupled to the back portion of the outer shell configured to allow a user to carry the container as a backpack.

13. An insulated container, comprising:

an outer shell defining a sidewall and a base, the outer shell having a front portion, a back portion, side portions, and a base portion;

an inner liner forming a storage compartment, the inner liner having a front portion and a back portion;

an insulating layer positioned between the front portion of the outer shell and the front portion of the inner liner and the insulating layer positioned between the back portion of the outer shell and the back portion of the inner liner, the insulating layer providing insulation for the storage compartment;

an opening at a top of the insulated container extending into the storage compartment, the opening having a front side and a back side;

a flap portion extending between a top of the outer shell and the opening;

a closure mechanism, further comprising:

a first closure element extending along and coupled to the front side of the opening; and a second closure element extending along and coupled to the back side of the opening, a first curved member spaced below the first closure element, wherein the first curved member has a first end, a second end, and a first curved member body extending between the first end and the second end; and a second curved member spaced below the second closure element, wherein the second curved member has a first end, a second end, and a second curved member body extending between the first end and the second end; and wherein the first closure element and the second closure element resealably seal the opening, and the first curved member and the second curved member prevent the opening from closing when the insulated container is in an open configuration; and wherein the second curved member is between the insulating layer and the outer shell.

14. The insulated container of claim 13, wherein the flap portion, when folded, is configured to provide a secondary seal of the opening.

15. The insulated container of claim 13, wherein the first curved member is received in a first receiver in the front portion of the outer shell, and the second curved member is received in a second receiver in the back portion of the outer shell, and wherein the first end and the second end of the first curved member are slidable within the first receiver.

16. The insulated container of claim 13, wherein the first curved member extends along the front portion of the outer shell and the second curved member extends along the back portion of the outer shell.

17. A container, comprising:

an outer shell defining a sidewall and a base, the outer shell having a front portion, a back portion, side portions, and a base portion;

an inner liner forming a storage compartment, the inner liner having a front portion and a back portion;

an insulating layer positioned between the front portion of the outer shell and the front portion of the inner liner and the insulating layer positioned between the back portion of the outer shell and the back portion of the inner liner, the insulating layer providing insulation for the storage compartment;

an opening at a top of the container extending into the storage compartment, the opening having a front side and a back side and wherein the container has an open configuration that allows access to the storage compartment and a closed configuration that prevents access to the storage compartment;

a flap portion extending between a top of the outer shell and the opening;

a closure mechanism, further comprising:

a first magnetic strip extending along and coupled to the front side of the opening; and a second magnetic strip extending along and coupled to the back side of the opening, a first curved member spaced below the first magnetic strip, wherein the first curved member has a first end, a second end, and a first curved member body extending between the first end and the second end;

a second curved member spaced below the second magnetic strip, wherein the second curved member has a first end, a second end, and a second curved member body extending between the first end and the second end;

wherein when the container is in the closed configuration, a portion of a first upper edge of the first curved member and a portion of a second upper edge of the second curved member are substantially parallel;

wherein the first magnetic strip is magnetically attracted to the second magnetic strip to resealably seal the opening, and the first curved member and the second curved member prevent the opening from closing when the container is in the open configuration; and wherein the second curved member is between the insulating layer and the outer shell.

18. The container of claim 17, wherein the first curved member is received in a first receiver in the front portion of the outer shell, and the second curved member is received in a second receiver in the back portion of the outer shell, and wherein the first end and the second end of the first curved member are slidable within the first receiver.

19. The container of claim 17, wherein the first curved member is fixedly attached to the front portion of the outer shell at a central region of the first curved member.

20. A closure mechanism comprising:

a first closure element positioned at a first side of an opening;

a second closure element positioned at a second side of the opening;

a first curved member, wherein the first curved member has a first end and a second end, and a first curved member body extending between the first end and the second end; and a second curved member, wherein the second curved member has a first end and a second end, and a second curved member body extending between the first end and the second end; and wherein the first closure element and the second closure element together resealably seal the opening, wherein the first curved member and the second curved member are configured to maintain the opening in an open configuration; and wherein the closure mechanism is connected to the opening at a top of a container, wherein the container comprises:

an outer shell having a front portion, a back portion, side portions, and a base portion;

an inner liner forming a storage compartment, the inner liner having a front portion and a back portion;

an insulating layer positioned between the front portion of the outer shell and the front portion of the inner liner and the insulating layer positioned between the back portion of the outer shell and the back portion of the inner liner, the insulating layer providing insulation for the storage compartment;

wherein the opening has a front side and a back side and wherein the container has the open configuration that allows access to the storage compartment and a closed configuration that prevents access to the storage compartment; and wherein the second curved member is between the insulating layer and the outer shell.

21. The closure mechanism of claim 20, wherein the first curved member body comprises a substantially rectangular cross-sectional shape and includes a portion formed from a steel alloy.

22. The closure mechanism of claim 20, wherein the first curved member includes a non-metallic coating and wherein the first end and the second end of the first curved member both have rounded corners.

23. The closure mechanism of claim 20, wherein the first curved member is received in a first receiver in the first side of the opening, and the second curved member is received in a second receiver in the second side of the opening.

24. The closure mechanism of claim 20, wherein both the first curved member and the second curved member flex from a first curved configuration for maintaining the opening in the open configuration to a second curved configuration when the opening is sealed.

25. The closure mechanism of claim 24, wherein when the first curved member and the second curved member are substantially parallel when in the closed configuration.

* * * * *